US005894729A

United States Patent [19]

Proeschel

[11] Patent Number: 5,894,729

[45] Date of Patent: Apr. 20, 1999

[54] AFTERBURNING ERICSSON CYCLE ENGINE

[76] Inventor: Richard A. Proeschel, 414 Pepperwood Ct., Thousand Oaks, Calif. 91360-2842

[21] Appl. No.: 08/954,359

[22] Filed: Oct. 20, 1997

Related U.S. Application Data

[XX .
[60] Provisional application No. 60/028,908, Oct. 21, 1996.

[51] Int. Cl.[6] ..... F01B 31/02
[52] U.S. Cl. ..... 60/508; 60/646; 60/560
[58] Field of Search ..... 60/508, 646, 650

[56] References Cited

U.S. PATENT DOCUMENTS 673,462 5/1901 Thorton et al. ..... 60/508

*Primary Examiner*—Noah P. Kamen
*Attorney, Agent, or Firm*—Walter Unterberg

[57] ABSTRACT

This invention is a heat engine operating on the afterburning Ericsson cycle whose principle is heat addition to the cycle by an afterburner in which fuel is burned with the low-pressure air working fluid exhausted by the expander. The resulting combustion gases are used in a countercurrent heat exchanger continually heating (1) the air expanding in the expander and (2) further upstream the high-pressure air (compressed by the compressor) in the regenerator. The ideal efficiency of this cycle is the Carnot cycle efficiency between the same top and bottom temperatures. Practical engines are more efficient than those in which heat addition takes place upstream of the expander. All moving parts are only exposed to clean air, and expander valves can be operated at temperatures comparable to current internal combustion engines. Liquid or gaseous fuels can be used and control of speed and power is simple, based on keeping engine temperatures constant. With the low-pressure continuous combustion, pumping and sealing problems are easily solved, engine noise level is low, and air-polluting emissions are minimal. Dual-cylinder engines with synchronized alternating pistons give rise to completely constant afterburner conditions which avoid thermal transients and facilitate engine operation. The performance of afterburning Ericsson cycle engines exceeds that of current internal combustion engines, in terms of thermal efficiency and specific fuel consumption.

14 Claims, 20 Drawing Sheets

AFTERBURNING ERICSSON CYCLE ENGINE

RELATED APPLICATION

This application covers the invention disclosed in my Provisional patent application Ser. No. 60/028,908 filed Oct. 21, 1996.

BACKGROUND OP THE INVENTION

1. Field of the Invention

This invention relates to heat engines operating on the Ericsson cycle which comprises the steps of isothermal compression, regenerative heat addition, isothermal expansion, and regenerative heat removal. More particularly, it relates to an improved Ericsson open cycle air engine where regenerative heat addition is effected solely by burning fuel in the expanded low pressure exhaust stream.

2. Description of Related Art

The Ericsson cycle, disclosed in Ericsson U.S. Pat. No. 13,348 (1855), U.S. Pat. No. 14,690 (1856), and U.S. Pat. No. 431,729 (1890) consists of isothermal compression of the working fluid at a low temperature followed by: heat addition at constant pressure to a high temperature, isothermal expansion at the high temperature, and heat removal at constant pressure to the low temperature. The Ericsson cycle can ideally achieve the optimum thermodynamic efficiency of the reversible Carnot cycle, dependent only on the absolute values of the high and low cycle temperatures.

Practical Ericsson engines are of the open cycle type with either internal or external combustion. Ericsson's original engines had an external combustor producing hot gases which supplied heat to the working fluid via a heat exchanger or by directly heating the exterior of the high temperature expander cylinder. These engines had limited success because the materials of the time could not withstand the high temperatures needed to compete with the fuel economy of contemporary steam engines. Also, the complexity of the Ericsson valve mechanism was a disadvantage compared to that of the simpler contemporary Stirling cycle engines. Another, more significant, drawback to the external combustion Ericsson engine is that fuel and air enter the external combustor at ambient environmental temperature. The energy required to heat the combustion gases to the high cycle temperature is not available to the working fluid and is lost to the cycle. The potential of the external combustion Ericsson cycle to approach Carnot cycle efficiency is therefore compromised by the combustion efficiency.

In the internal combustion Ericsson cycle engine the combustion efficiency loss of the external combustion Ericsson cycle engine can be avoided by using the working fluid as the combustor air. Combustion is initiated in the high pressure/high temperature air stream between the regenerator and the, expander. In this way the air is preheated by the regenerator and the heating loss is minimized.

Previous internal combustion Ericsson cycle engines have been of the gas turbine or reciprocating type. The gas turbine version, used for large-scale power generation, is based on a Brayton cycle having a compressor with multiple intercooled stages, and an expander with multiple stages having intermediate reheaters. As the, number of intercoolers and reheaters is increased, the compression and expansion become more isothermal and the cycle approaches the Ericsson cycle.[Lay, Joachim E.: "Thermodynamics", Charles E. Merrill Books (1963) p.572]. The turbine Ericsson cycle is impractical for all but large powerplants because of the high cost and complexity of the multiple stage turbines.

Reciprocating Ericsson cycle engines are more economical for small scale power generation. Fuel is injected into and burned with air, the normal working fluid, to achieve heat addition. Here, as in other open-cycle internal combustion engines, valves are required to admit and exhaust air and hot combustion gas streams. Top cycle temperatures and pressures are limited by the thermo-structural properties of valve materials.

An example of the internal combustion approach is the "Modified Ericsson° Cycle Engine" disclosed in U.S. Pat. No. 4,133,172 (1979) to Cataldo. Here fuel is injected and burned in the high temperature/high pressure air stream between the Ericsson cycle regenerator and expander. Although combustion efficiency is boosted by preheating the combustion air by an exhaust gas regenerator, the combustion process becomes complex and is not everywhere continuous. Combustion occurs continuously in a primary combustor located between the regenerator and the expander. However, during the expansion, the expander inlet valve closes and isolates the primary combustor from the expander. Additional fuel must then be added via a second, intermittent, combustor to the expander to keep the expansion isothermal. This two-stage process requires two separate high-pressure fuel injection systems, one, continuous and the second synchronized with the downstroke of each individual expander. A proper amount of fuel must be injected into each stage to assure smooth running, maximize efficiency and minimize emissions. The required amounts vary continuously with load conditions, engine speed, and temperatures. The result is a very complex engine with a high potential for unsatisfactory exhaust emissions, particularly during transients. A further limitation of the Cataldo engine is that the expander inlet valves are exposed to the full flame temperature of the primary combustor. The inability of valves to tolerate such high temperatures—at high pressure—has historically limited the life of Ericsson engines.

It is the primary aim of this invention to overcome the disadvantages of current Ericsson cycle engines discussed above and to achieve long engine life, reduced emissions and ease of control by implementing the several objects listed below.

OBJECTS OF THE INVENTION

It is an object of this invention to provide an Ericsson cycle engine in which the expander valves are exposed to temperatures significantly below the full combustion flame temperature.

It is another object to provide an Ericsson cycle engine in which all moving parts are exposed only to clean air.

It is a further object to provide an Ericsson cycle engine in which the combustion process is totally continuous and takes place at low pressure.

It is still another object to provide an Ericsson cycle engine in which power and speed are controlled instantly by a conventional throttle mechanism.

It is yet a further object to provide an Ericsson cycle engine which can be powered by a wide variety of liquid or gaseous fuels.

It is another object to provide an Ericsson cycle engine which operates at a low noise level.

SUMMARY OF THE INVENTION

To implement the stated objects of the invention an Afterburning Ericsson Cycle Engine has been devised. The principal feature of the invention is heat addition to the cycle by an afterburner in which fuel is burned with the low-pressure air working fluid exhausted by the expander. The expander exhaust air thus is converted to hot gases at the combustion flame temperature which are then directed through a heating jacket around the outside of the expander cylinder. This forms a countercurrent heat exchanger continually heating the air working fluid expanding in the expander cylinder to maintain a close to isothermal expansion, After the hot gases from the afterburner leave the heating jacket around the expander cylinder, they are ducted through a similar jacket around the regenerator to form a countercurrent heat exchanger to heat up the air compressed by the compressor before this air enters the expander. Then the gases, having given up heat to expander and regenerator, are exhausted to atmosphere in the open cycle application.

A number of distinct advantages of the Afterburning Ericsson Cycle Engine can be listed:

1. For a true isothermal expansion the cycle efficiency is the maximum obtainable Carnot cycle efficiency. Even in practice, the level of cycle efficiency exceeds that available with engines where heat addition takes place upstream of the expander.
2. Long engine life is obtained because the expander valves are not exposed to the full combustion flame temperature, but can be operated at temperatures comparable to current Otto or Diesel cycle internal combustion engine exhaust valves.
3. All moving parts are exposed only to clean air rather than combustion products which could limit life and performance from carbon buildup.
4. With the low-pressure continuous combustion no high-pressure fuel pump or high-pressure seals are needed.
5. Complete combustion and minimal air polluting emissions are assumed with the low-pressure continuous combustion.
6. The Afterburning Ericsson Cycle engine can be controlled by conventional internal combustion engine throttle techniques. Speed and power are controlled by a butterfly valve on the compressor inlet coupled with variable fuel control. The aim is to maintain nearly constant engine temperatures while varying air and fuel flowrates. This produces rapid throttle response since no thermal lags are introduced.
7. The engine can be powered by a wide variety of liquid or gaseous fuels, including gasoline, diesel fuel, propane and hydrogen.
8. The, engine has a low exhaust pressure which results in quiet operation which is enhanced by the muffling effect of the expander and regenerator exhaust cooling process.

BRIEF DESCRIPTION OF THE DRAWINGS

A better understanding of the invention may be gained by reference to the following Detailed Description in conjunction with the drawings provided in which.

DETAILED DESCRIPTION OF THE PREFERRED EMBODIMENTS

Afterburning Ericsson Cycle Characteristics

Figure 1:
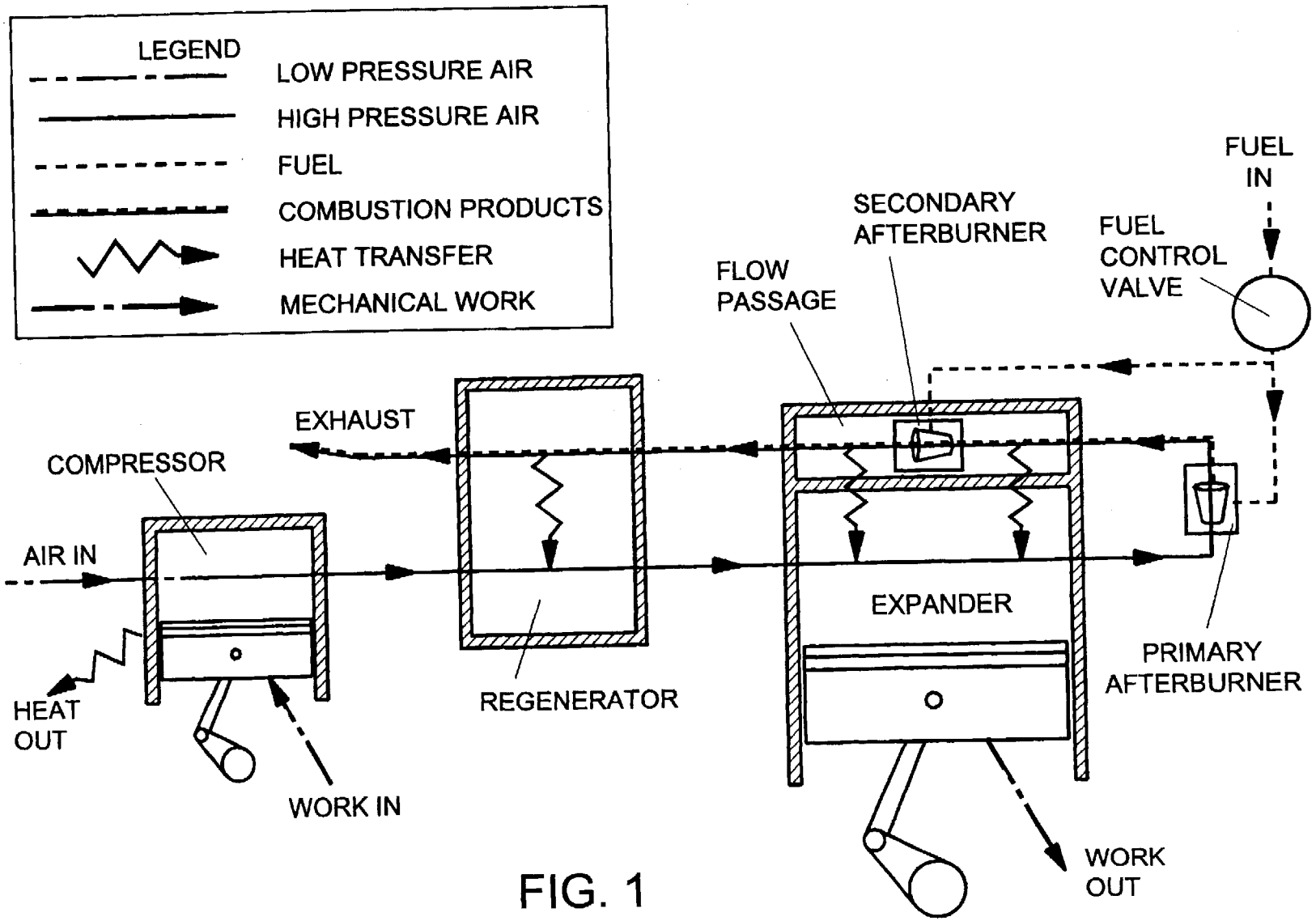
FIG. 1 is a functional block diagram of the afterburning Ericsson cycle.

FIG. 1 is a functional block diagram of the afterburning Ericsson open cycle with internal combustion. Ambient air is compressed by a compressor and then heated in a regenerator before, expanding in an expander. Fuel is added to the fully expanded air to form a combustible fuel-air mixture which is burned in an afterburner (shown as primary plus secondary) to generate hot exhaust gases which become the hot gas side of a counter-current heat exchanger transferring heat to the air in the expander and regenerator before exhausting to atmosphere.

The fuel energy entering the system results in a net work output, usually in the form of shaft power. The inefficiencies of the system appear as waste heat rejected by the compressor and in the exhaust stream, plus the work input required to drive the compressor. Mechanically, the system can be realized in the form of rotating or reciprocating compressors and expanders.

Ideal Cycles

Figure 17:
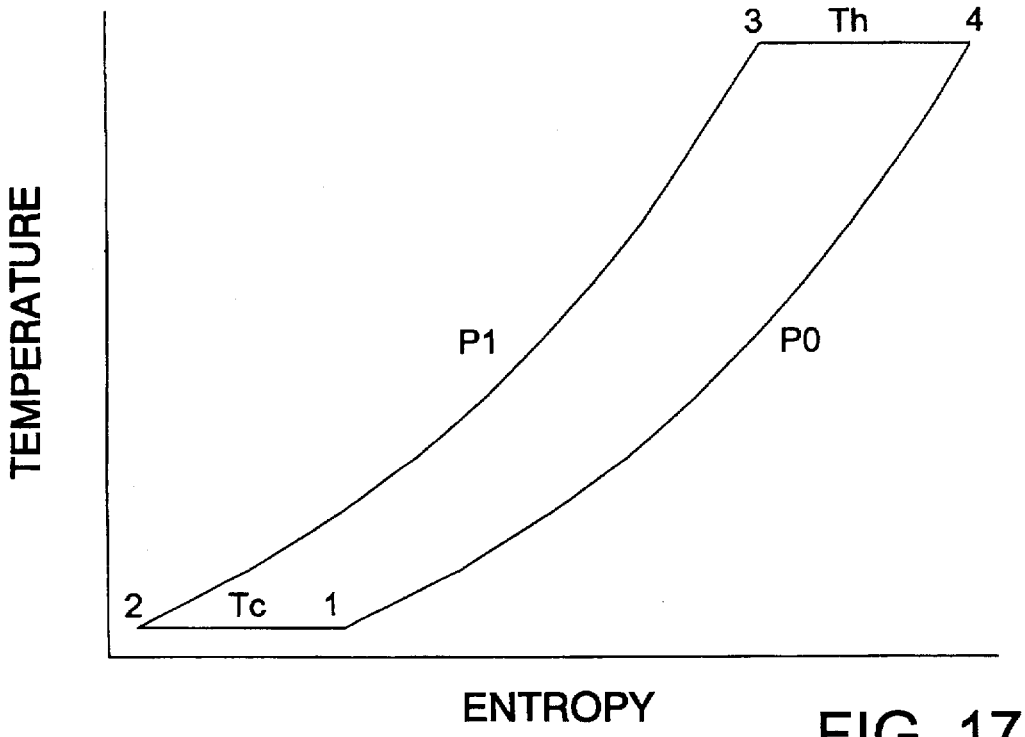
FIG. 17 is a temperature entropy diagram of the ideal Ericsson cycle.
Figure 18:
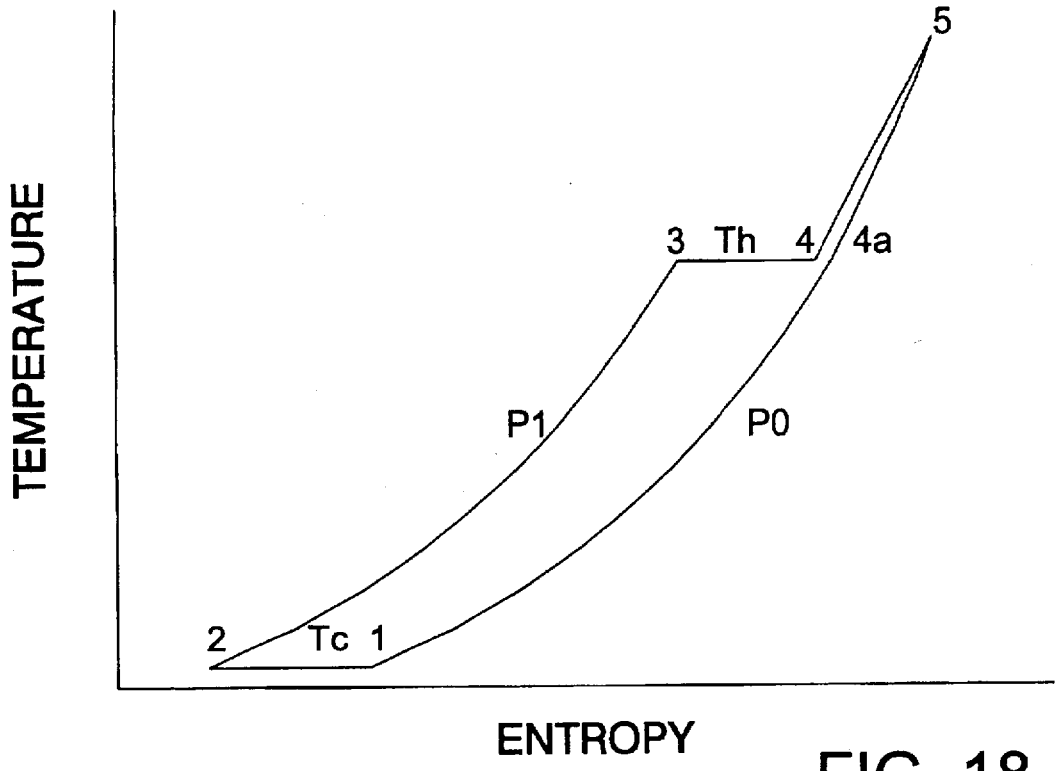
FIG. 18 is a temperature-entropy diagram of the ideal afterburning Ericsson cycle.

FIG. 17 and FIG. 18 show the ideal Ericsson cycle and the ideal afterburning Ericsson cycle, respectively, on temperature-entropy diagrams. In FIG. 17 the cycle points are numbered 1-2-3-4-1. The working fluid, such as air, is compressed isothermally at a cold temperature Tc from a low pressure Po (point 1) to a high pressure P1 (point 2). Constant pressure heating at P1 from Tc (point 2) to high temperature Th (point 3) is followed by isothermal expansion at Th from point 3 to point 4. Lastly, constant pressure cooling at Po from Th (point 4) to Tc (point 1) completes the cycle. Using a regenerator allows the heat required for heating from point 2 to point 3 to be obtained from the heat rejected during cooling from point 4 to point 1. Heat is added during the isothermal expansion (point 3 to point 4) and removed during the isothermal compression (point 1 to point 2). The efficiency of this cycle is the same as that of the Carnot cycle operating between Tc and Th.

In FIG. 18 the cycle points are numbered **1-2-3-4-5-4*a*-1. The state points 1,2,3,4 and 4*a* are the same as for the ideal Ericsson cycle. However, the additional process from point 4 to point 5 represents the afterburning process where the isothermal expander exhaust is heated at constant pressure Po from the expander temperature Th to the afterburner flame temperature Tf at point 5. The process from point 5 to point 4*a* is the heat transfer from the expander heating passages (see FIG. 1) to the expanding air within the cylinder. The heat added in going from point 4 to point 5 is the same as the heat required for isothermal expansion from point 3 to point 4** and allows the required flame temperature to be calculated from $$H5-H4=Th(S4-S3) \tag{4a}$$

where

H5=Enthalpy at flame temperature Tf and Po

H4=Enthalpy at expander temperature Th and Po

S3,S4=Entropy at beginning and end of expansion.

For an ideal gas the flame temperature Tf is given by solving (4a):

$$Tf=Th[1+(S4-S3)/Cp] \tag{4b}$$

or $$Tf=Th[1+(R/Cp)ln(P1/Po)] \tag{4c}$$

where

R=Gas constant

Cp=Specific heat at constant pressure ln=Natural logarithm

Because the area within the T-S diagram for the ideal afterburning Ericsson cycle **1-2-3-4-5-4*a*-1 is the same as for the ideal Ericsson cycle 1-2-3-4-1**, the cycles have the same efficiency E which is the Carnot efficiency, E=1−(Tc/Th) (1) Combining (1) and (4c) allows E to be defined in terms of Tf and Tc as $$E=1-Tc[1+(R/Cp)ln(P1/Po)]/Tf \tag{5a}$$

Figure 19:
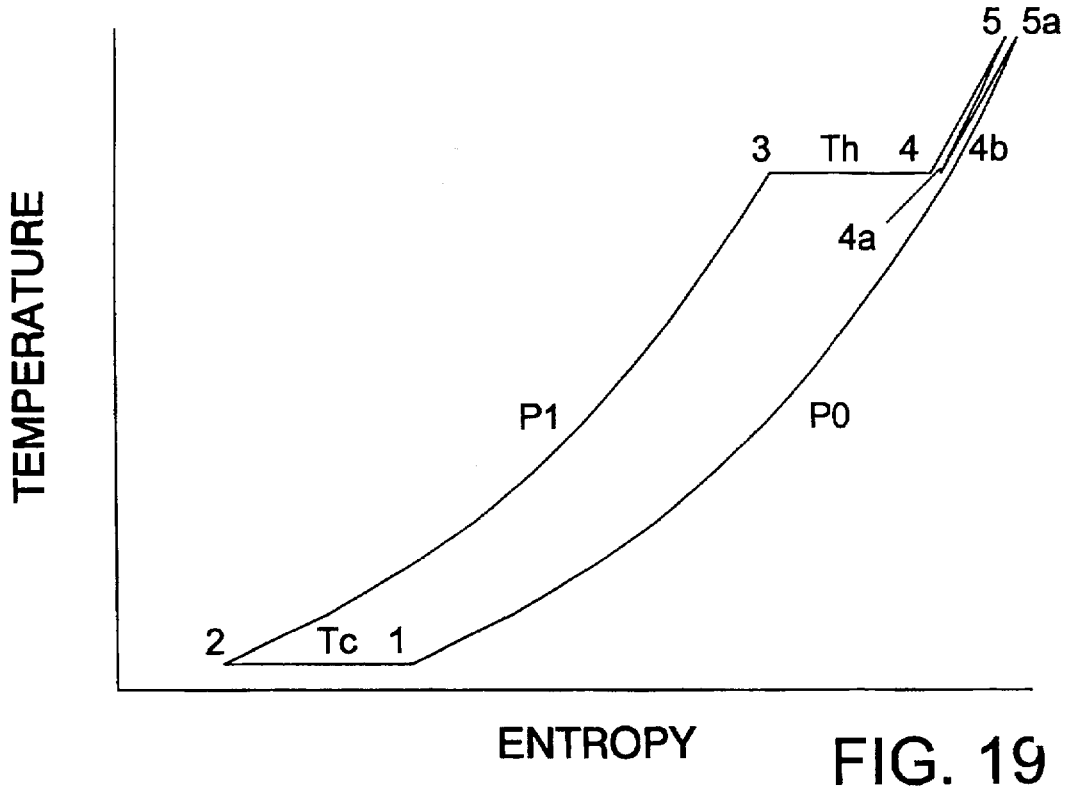
FIG. 19 is a temperature-entropy diagram of the ideal afterburning Ericsson cycle with an additional burner in the expander passage.

Referring to FIG. 19, the ideal afterburning Ericsson cycle with an additional burner located in the expander heating passages becomes **1-2-3-4-5-4*a*-5*a*-4*b*-1. During each passage through a burner (points 4 to 5, and points 4*a* to 5*a*), the air combustion products increase in temperature. Heat is then transferred to the air within the expander during each passage from points 5 to 4*a* and points 5*a* to 4*b***. The repeated heating/cooling process allows a lower flame temperature given by $$Tf=Th[1+(R/nbCp)ln(P1/Po)] \tag{4d}$$

where nb =total number of burner.

The cycle Efficiency then becomes $$E=1-Tc[1+(R/nbCp)ln(P1/Po)]/Tf \tag{5b}$$

As more burners are added; Tf approaches Th, and the cycle approaches the ideal Ericsson cycle.

Real Cycle Effects

Figure 20:
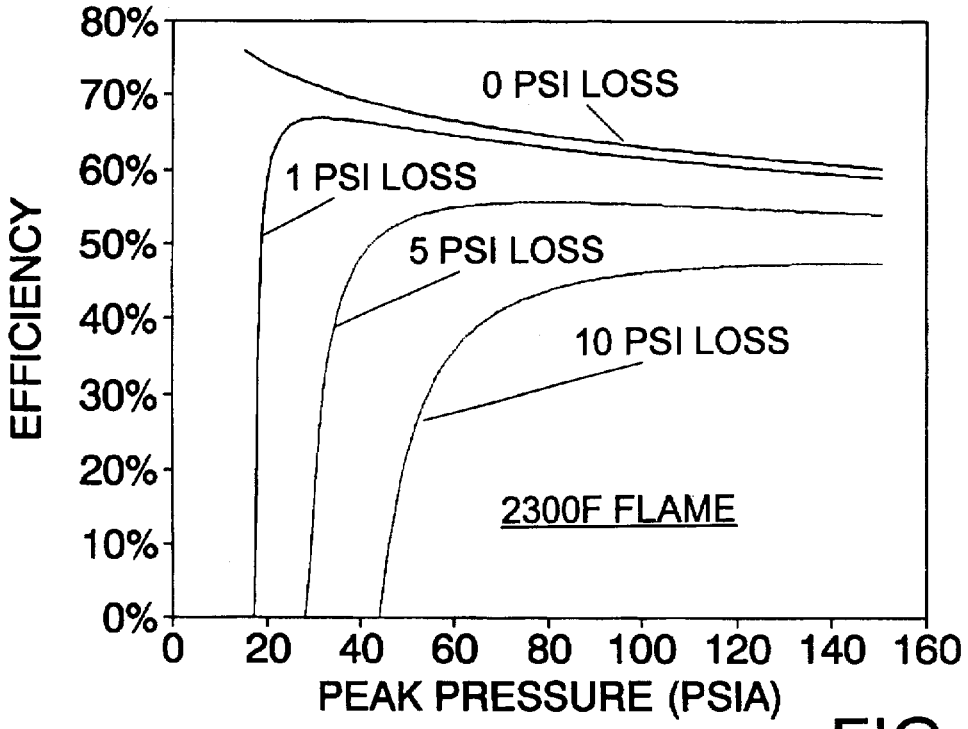
FIG. 20 is a graph of the efficiency of a real afterburning Ericsson cycle as a function of peak pressure and flow pressure loss.

Referring to FIG. 20, the afterburning cycle efficiency is shown for ideal and real engines with Tf=2300 F. and a single burner (nb=1). Assuming Tf and Tc are fixed by material limits and ambient temperature, respectively, (5a) and (5b) predict that the efficiency of the afterburning Ericsson cycle engine increases as pressure ratio P1/Po decreases, or as P1 decreases for constant Po. This is shown for the ideal engine with zero pressure loss, in the top curve of FIG. 20.

The real engine has flow pressure losses, thermal efficiency losses, heat losses and mechanical losses. All these determine the optimum pressure ratio for the real engine. Assuming that the flow losses between compressor and expander, and from expander to atmosphere are equal and represented by dP, (5b) is modified to $$E=1-(X/Y) \tag{6}$$

where $$X=Tc.ln(P1/Po)\{1+(R/nbCp)ln[(P1-dP)/(Po+dP)]\}$$

$$Y=Tf.ln[(P1-dP)/(Po+dP)]$$

Inserting pressure losses dP from 1 to 10 psi in (6) results in the lower curves oh FIG. 20. These show that as dP increases, higher values of peak pressure (i.e., P1/Po) are needed to attain optimum efficiencies.

Figure 21:
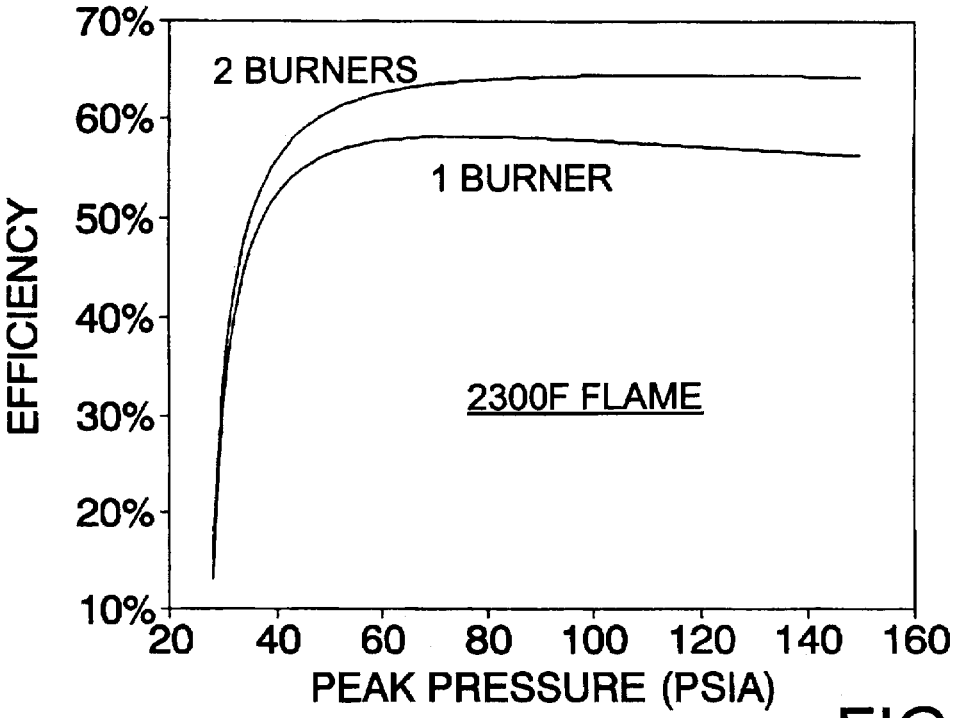
FIG. 21 is a graph of the efficiency of a real afterburning Ericsson cycle as function of peak pressure and number of burners.

Referring to FIG. 21, the efficiencies of cycles with one and two burners are compared at Tf=2300 F. and dp=5 psi. The dual-burner engine has a distinctly higher efficiency, an example of the advantage of multiple burners.

Thermal efficiency losses arise from the heat transfer resistance on the inside and outside of the compressor and expander walls and on the high pressure and low pressure sides of the regenerator. The average heat transfer coefficient within the expander and compressor cylinders can be estimated using relations obtained from the literature for internal combustion engines. Similarly, heat transfer relations for the cooling flow outside the cylinder walls and within the regenerator can be estimated using standard heat transfer formulations based on hydraulic diameter.

Figure 22:
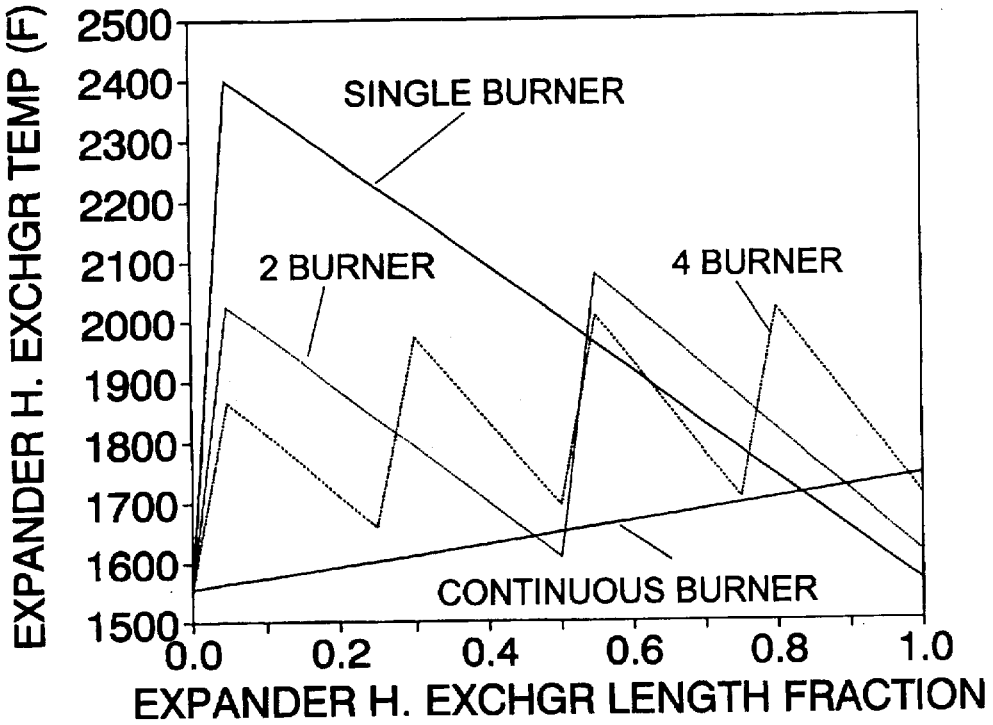
FIG. 22 is a graph of expander heat exchanger temperature as a function of the number of burners.

Referring to FIG. 22, typical temperatures along the expander heating passage are shown for a constant heat transfer rate as a function of the number of burners (nb=1,2,4 and infinity—the last being equivalent to continuous burning throughout the expander heating passage). The ability to transfer heat into the expander limits the potential gain from multiple burners. Going from one to two burners greatly reduces the difference between the peak flame temperature and the expander wall (assumed constant at 1400 F.). However, the peak temperature is only slightly reduced between nb=2 and nb=4 because the heat transfer is insufficient to cool the hot air/combustion products to the wall temperature between burners. For this case increasing the number of burners beyond two has little gain for the additional complexity., Referring to FIG. 23, a temperature-entropy diagram is shown for a typical non-ideal afterburning Ericsson cycle engine. The curves were generated by a computer model which accounts for the typical real losses expected in a small (3.5 horsepower) two-burner afterburning Ericsson cycle engine operating at 3000 rpm with a 2100 F. flame temperature, 80 psia peak pressure and 3 psi mean flow losses. Ambient air is at 70 F. and 14.7 psia. The compression process 1–2 differs from the ideal isothermal process, showing a sharp temperature rise as the incoming air is heated by the cylinder wall which is at a steady state temperature above ambient.

Figure 24:
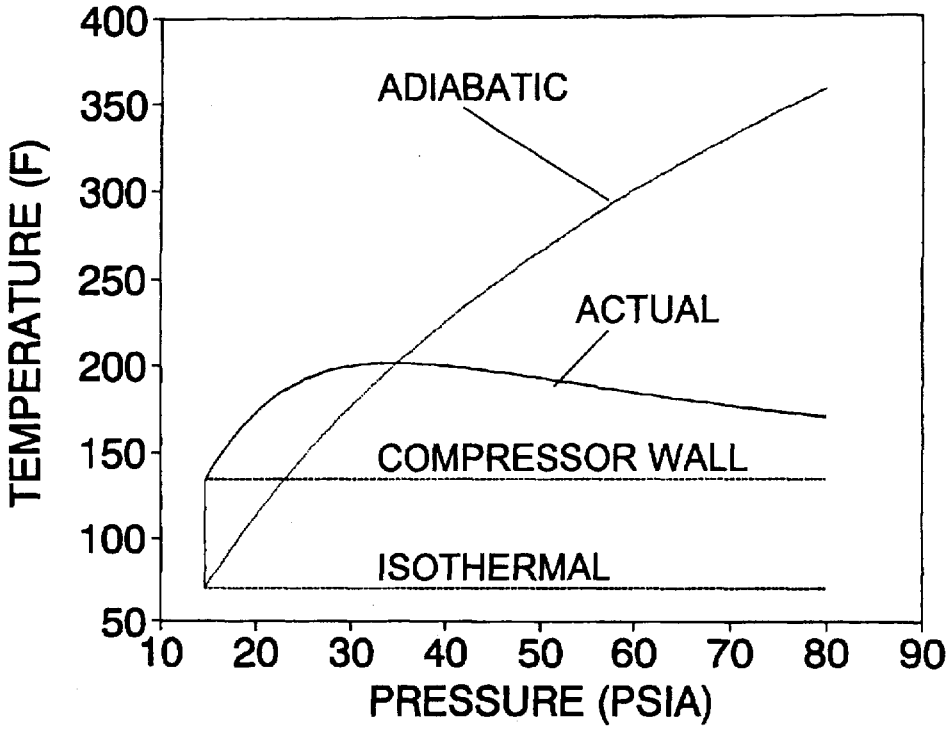
FIG. 24 is a graph of compressor temperature as a function of pressure and compression process.

Referring to FIG. 24, compressor temperatures are shown during the compression process from ambient to 80 psi. The actual temperature rises with pressure increase to a point where the heat transfer to the wall exceeds the rate of compression heating, after which the retaining compression takes place nearly isothermally, but at a temperature much above ambient, typically 180 F.

Figure 25:
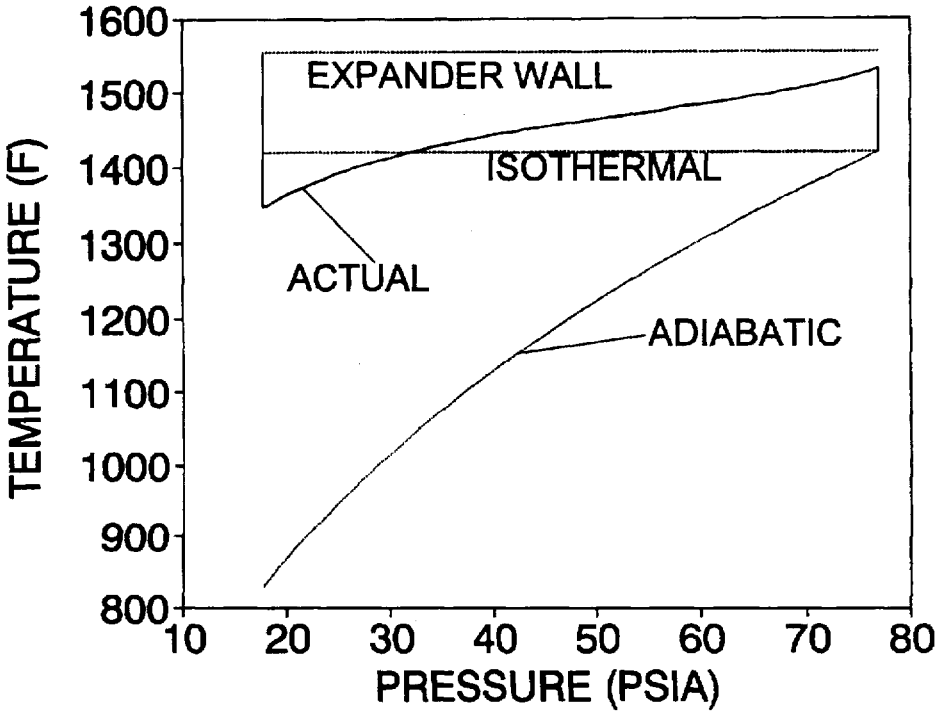
FIG. 25 is a graph of expander temperature as a function of pressure and expansion process.

Referring to FIG. 25, expander temperatures are shown during the non-ideal expansion process, from right to left in the graph. The incoming air is warmed by the expander wall prior to cutoff, cools during expansion and then is reheated as it is exhausted from the expander.

Referring again to FIG. 25, at point 1*a* which is the end of the cycle, the air is cooled to 350 F. rather than the ambient 10 F. This is due to the less than ideal heat exchanger, effectiveness.

Figure 23:
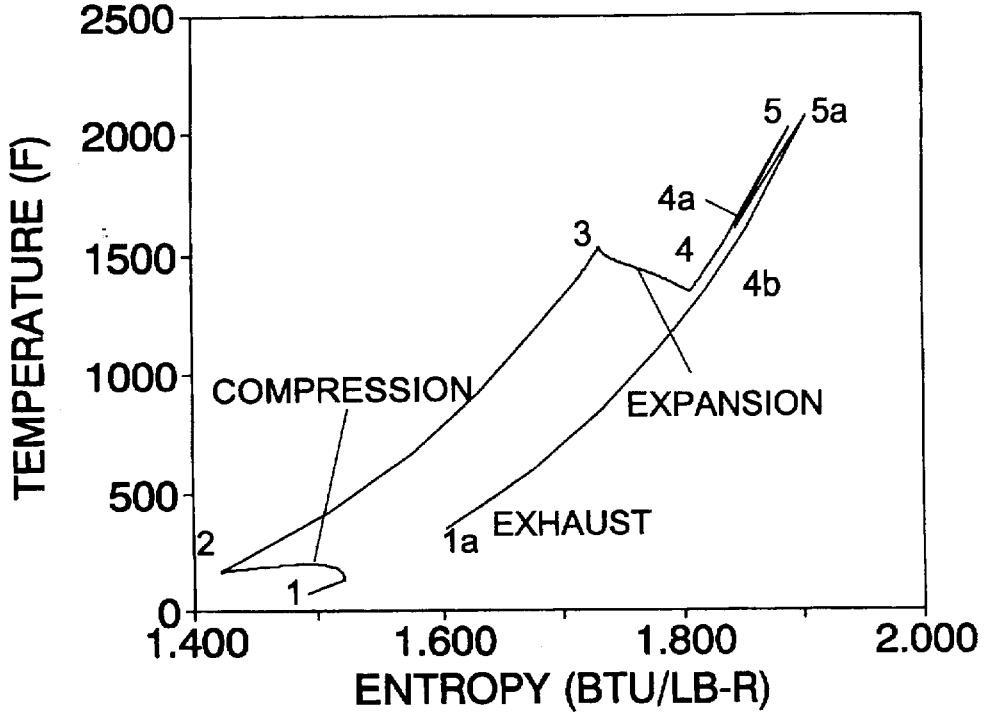
FIG. 23 is a temperature-entropy diagram for a typical real afterburning Ericsson afterburning engine.

The realistic cycle of FIG. 23 exhibits a number of non-ideal effects, some of which were further discussed in FIG. 24 and FIG. 25. Nevertheless, this cycle has a predicted brake efficiency of 42% and a specific fuel consumption with gasoline of 0.35 lb/bhp-hr. This brake efficiency exceeds that of current comparable small spark-ignition internal combustion engines by at least 25 percent, and that typical of larger automobile engines by 30 percent.

Single Cylinder Reciprocating Engine Embodiment

Figure 2:
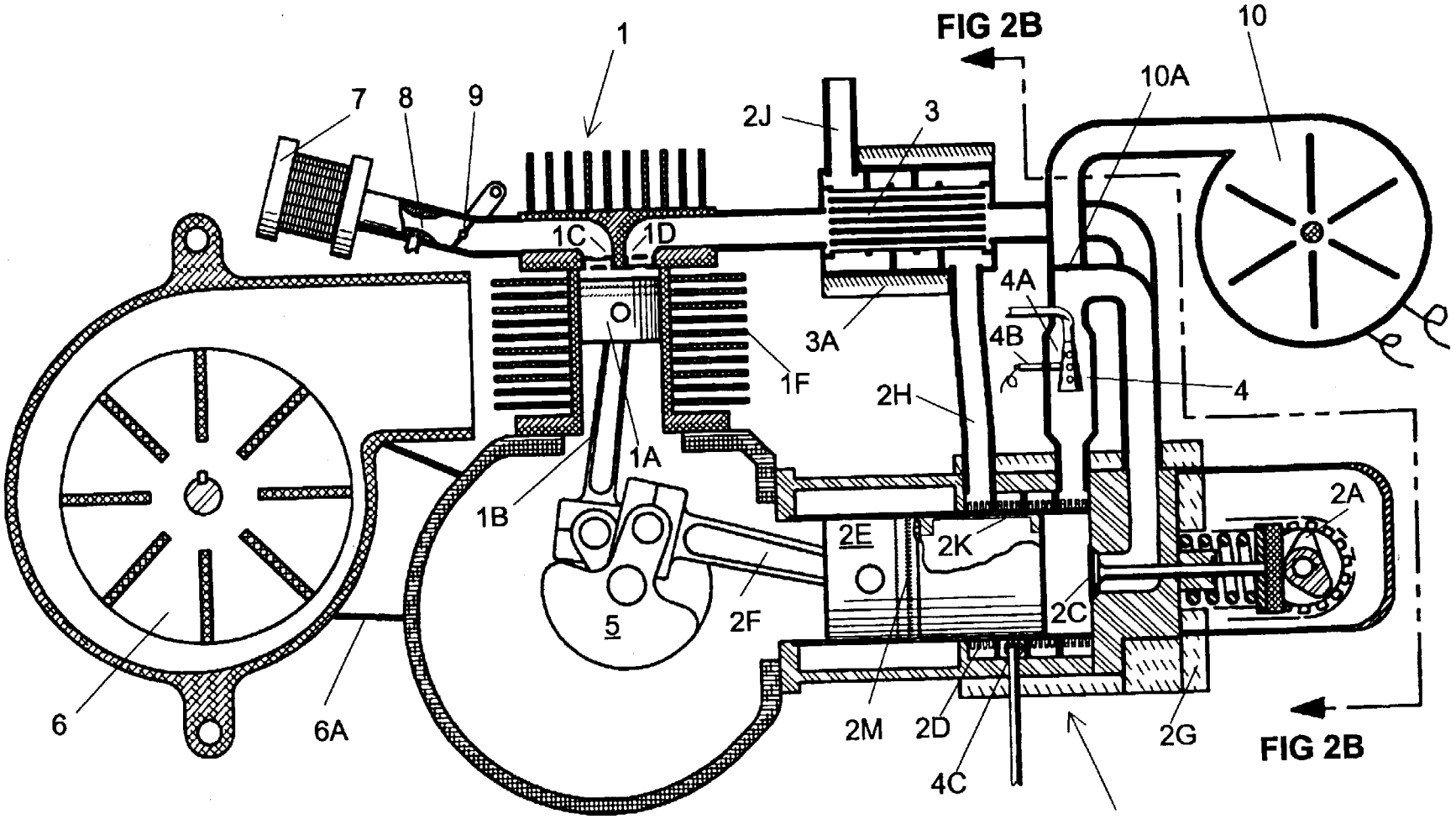
FIG. 2 is a reciprocating single-expander afterburning Ericsson cycle engine shown in cross-section.
Figure 2B:
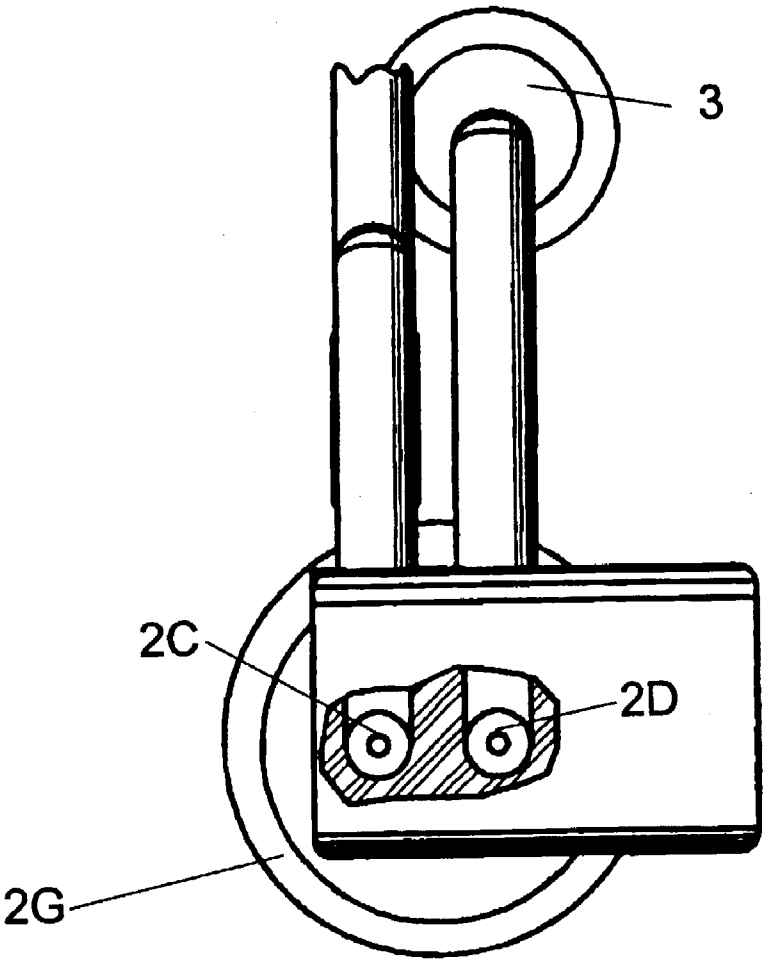

Referring to FIG. 2, the Afterburning Ericsson Cycle will be illustrated as embodied in an open cycle reciprocating air engine with a single cylinder compressor 1, a single cylinder expander 2, a regenerator 3, and at afterburner 4. The energy input to the engine is via the fuel supplied to afterburner 4. The engine puts out shaft power via crankshaft 5 which has two cranks to which compressor cylinder 1 and expander cylinder 2 are connected in proper phase relationship. In particular, compressor piston 1*a* is connected to one crank by compressor connecting rod 1*b*, and expander piston 2*e* is connected to the other crank by expander connecting rod 2*f*.

Compressor 1 operates much like a standard air compressor using conventional air compressor disk or feather check valves 1*c* and 1*d*. The compressor air is tooled by cooling fins 1*f* which give up heat via forced convection to ah air stream created by a blower 6 which is driven by a belt 6*a* powered by crankshaft 5 via pulleys.

An alternative is natural convection air cooling of fins 1*f* without blower 6. A cooling alternative is to replace fins 1*f* by a coolant loop consisting of cooling jackets, circulating pump and radiator, to approximate isothermal compression.

The proper compressor cooling method is selected based on the application of the engine and a tradeoff between the availability of natural air circulation and the parasitic loss incurred by a water cooling loop, blower or fan.

Expander 2 is connected to compressor 1 through regenerator 3 which preheats the compressed air. Expander 2 is a cylinder similar to a standard internal combustion engine cylinder with an intake valve 2*b* and an exhaust valve 2*c*, both driven by cam 2*a*, for control of the air flow through expander 2. Expander 2 is externally heated by the hot combustion product/air stream from afterburner 4 which flows through heat transfer passage 2*d* around expander 2. Expander insulation 2*g* is provided to minimize heat loss from expander 2.

Figure 11:
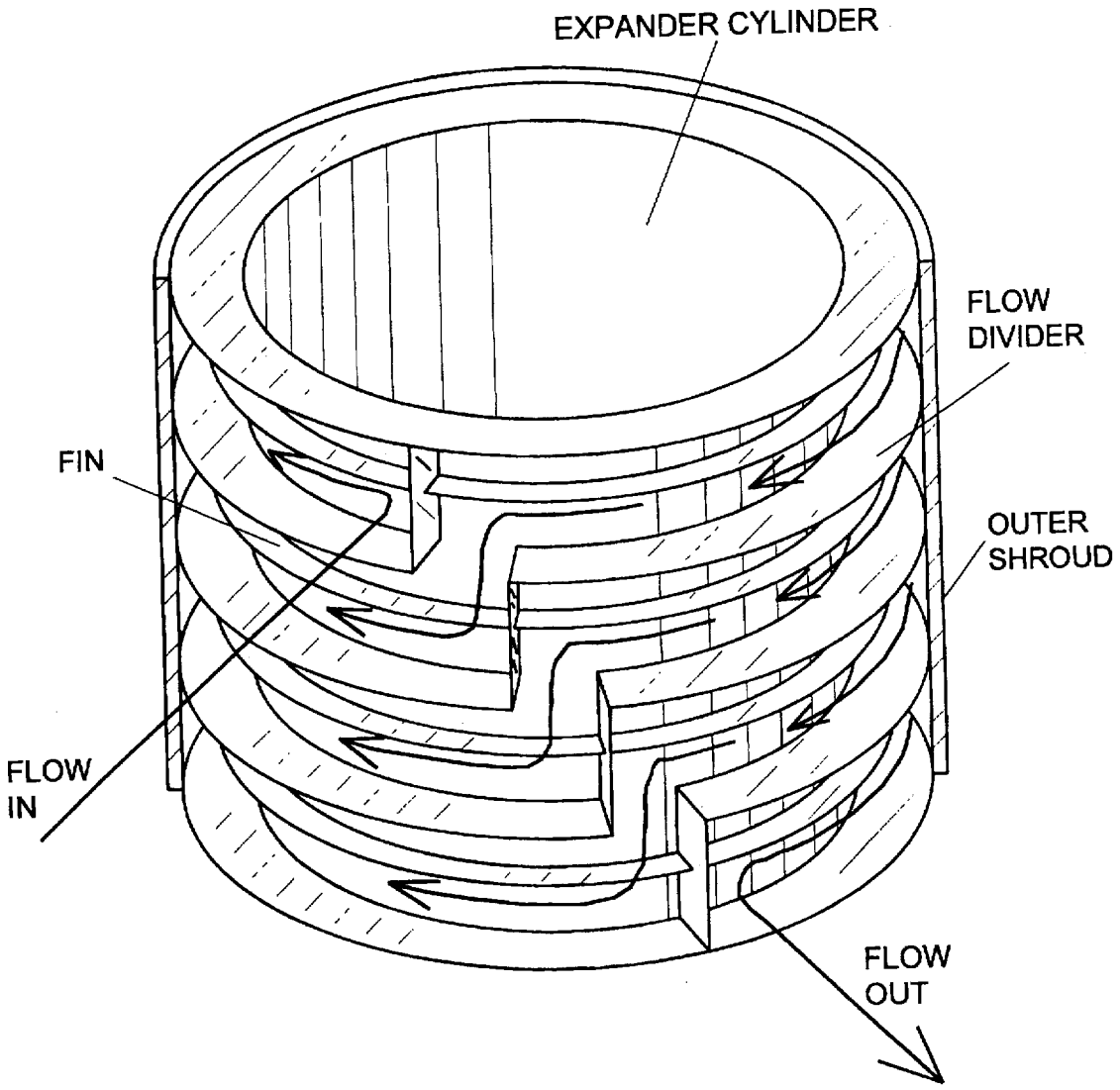
FIG. 11 is a pictorial view of an expander cylinder showing heat exchanger passages.

Referring now to FIG. 11, a pictorial view of expander 2 with heat transfer passage 2*d*, details of the flow configuration are shown. Passage 2*d* comprise multiple annular flow dividers, each divider partially encircling expander cylinder 2. This creates a gap which contains a blocking plate to divert the flow through the gap to the next lower level. An outer jacket covers all flow dividers to create multiple, interconnected flow passages.

Hot combustion products enter the top flow passage, travel around the exterior of expander cylinder 2 until they reach the blocking plate and gap. Then they drop through the gap to the next level where they again circle expander cylinder 2 until they reach the next gap. She flow of gaseous hot products thus continues in a circular stair step manner until it has circulated around the entire exterior of the heated portion of expander cylinder 2.

Such a flow geometry increases the velocity of the hot flow circulating around expander 2, increases its Reynolds number, and thus enhances the heat transfer rate from the hot gas flow to expander 2. One or more fins in each flow passage further enhance the heat transfer by augmenting the effective heat transfer area and by further increasing the flow velocity.

Engine Operation

Referring again to FIG. 2, air enters the engine through an air filter 7, passes through a venturi 8 and a butterfly valve 9 which regulates speed and power by controlling the amount of fuel and air entering the engine. The air then enters compressor cylinder 1 through intake check valve 1*c*. After compression, the air exits. through compressor exhaust check valve 1*d* and flows through regenerator 3 where it is heated by hot air/combustion products exiting expander heating passages 2*d* through a connecting tube 2*h*.

The air then enters expander 2 through expander intake valve 2*b* and expands as expander piston 2*e* moves down cylinder 2. Heat is transferred to the expanding air from heating passages 2*d* through the wall of cylinder 2 to provide continuous heating throughout expansions. Intake valve 2*b* closes after piston 2*e* is only part way down cylinder 2 so that the initial air volume can fully expand and produce work. The pressure ratio P1/Po of the engine is determined by the timing of this intake valve cutoff, combined with the crank geometry and the volumes of cylinders 1 and 2.

After expander piston 2*e* reaches bottom dead center, expander exhaust valve 2*c* opens and remains open until piston 2*e* moves to top dead center. The low pressure air now flows put of valve 2*c* into afterburner 4. During this process the air is reheated by the internal wall of cylinder 2 and enters afterburner 4 at a high temperature. Fuel is injected into afterburner 4 through a fuel nozzle located within burner can 4*a*. Once the engine is running and warmed up, no ignition means is required since the expander exhaust. temperature is well above the fuel/air ignition temperature. During startup, however, a spark ignitor 4*b* is used to ignite the fuel/air mixture.

After exiting afterburner 4 the hot air/combustion products swirl around the outside walls of expander cylinder 2 in passages 2*d* (see FIG. 11) to transfer heat to the air working fluid for isothermal expansion. An additional burner, or burners, 4*d* can be located in passages 2*d* to minimize the requirement for high flame temperature (see FIG. 21). The combustion product/hot air mixture then passes through connecting tube 2*h* to regenerator 3, which is insulated against heat loss by insulation 3*a*, to preheat the incoming high pressure air stream from compressor exhaust valve id.

The cooled air/combustion products then exit the engine via exhaust pipe 2*j*.

The engine is started with starter blower 10 and starter valve 10*a*. Before the engine is cranked for starting, valve 10*a* is opened to allow air flow from electrically driven blower 10 into afterburner 4 main burner. An electric or electronic ignitor 4*b* is turned on and fuel is admitted through fuel nozzle 4*a*. After ignition, ignitor 4*b* is turned off as steady state combustion of the fuel/air mixture continues. The heated combustion products circulate around expander 2 and exit through regenerator 3, thereby heating both expander 2 and regenerator 3. When expander 2 is warmed to the ignition temperature of the fuel, fuel is admitted to secondary burner 4*d* which ignites from fuel impacting the heated metal. After expander 2 and regenerator 3 are heated to normal operating temperature, the engine is cranked over by an electric starter motor (not shown), When the engine begins to rotate, valve 1*a* is closed, blower 10 is turned off, and the engine begins normal operation.

Dual Cylinder Reciprocating Engine Embodiment

Although a single compressor/expander set is depicted in FIG. 2 for clarity, the preferred configuration is at least two expander cylinders associated with at least two compressor cylinders, with a common regenerator and afterburner. A dual-cylinder engine is arranged with expander cranks out of phase, i.e., 180 degrees apart, so that air flows continuously, rather than intermittently, into the single afterburner to produce enhanced combustion and a higher combustion efficiency.

Referring now to FIGS. 3–10, these are crank angle diagrams for a dual-cylinder open-cycle afterburning Ericsson engine with alternating synchronized pistons. The complete engine cycle occurs during one crankshaft revolution, i.e., 360 degrees rotation. These diagrams show compressor and expander piston positions, intake and exhaust valve positions, and flows of air working fluid and hot combustion products every 45 degrees rotation, or at 8 points in the cycle. One pair of (compressor+expander) cylinders is designated "A", and the other pair "B".

Figure 3:
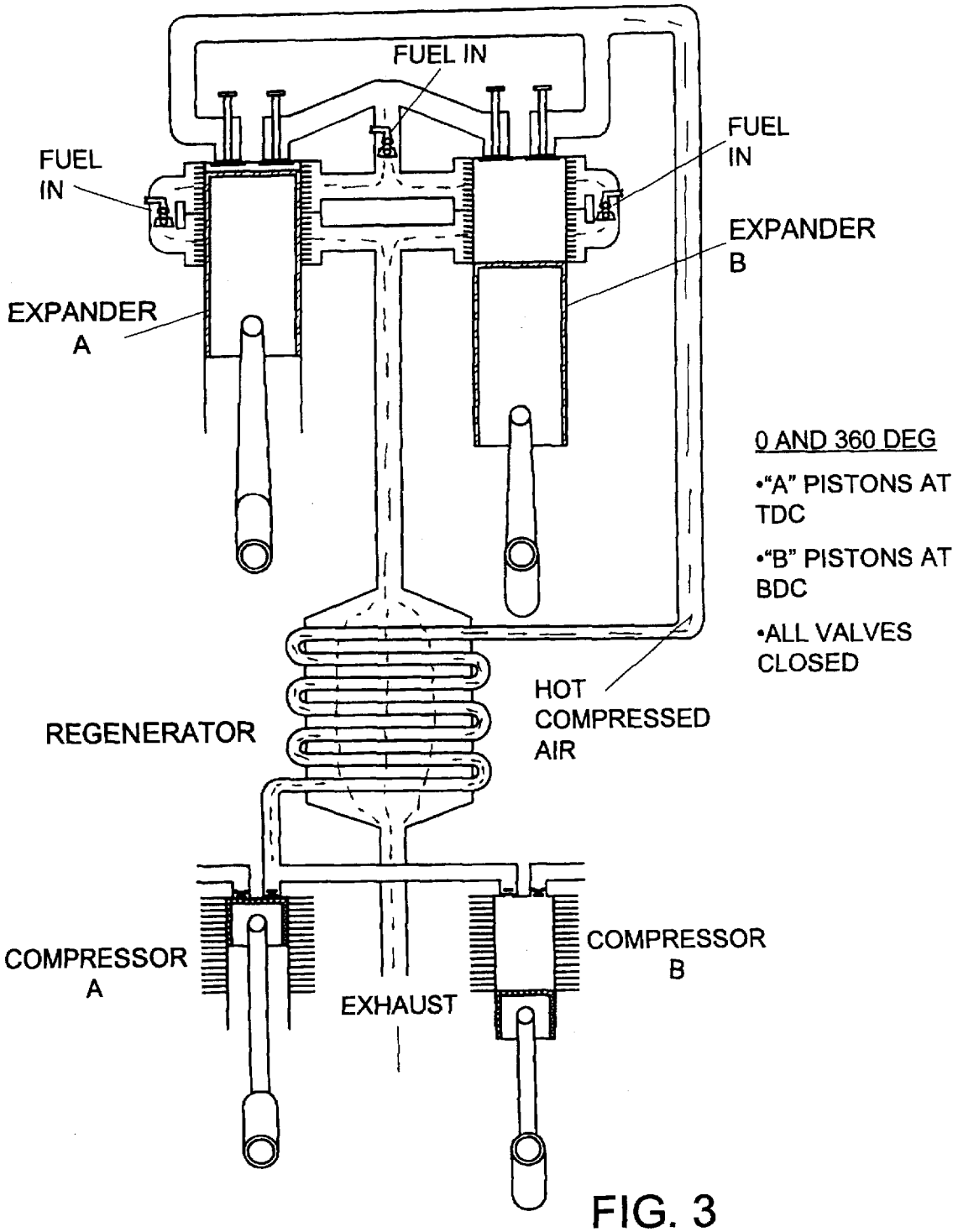
FIGS. 3–10 are schematics of a dual-cylinder afterburning Ericsson cycle engine with synchronized alternating pistons shown at successive crank angle positions during the complete cycle, i.e., FIG. 3 at zero and 360 degrees, FIG. 4 at 45 degrees, FIG. 5 at 90 degrees, FIG. 6 at 135 degrees, FIG. 7 at 180 degrees, FIG. 8 at 225 degrees, FIG. 9 at 270 degrees, and FIG. 10 at 315 degrees.

FIG. 3 shows the start position at zero or 360 degrees rotation, when the "A" pistons are at top dead center (TDC) and the "B" pistons are at bottom dead center (BDC), and the intake and exhaust valves in all four cylinders are closed. Both "B" cylinders are filled with air. Both "A" cylinders are empty.

Figure 4:
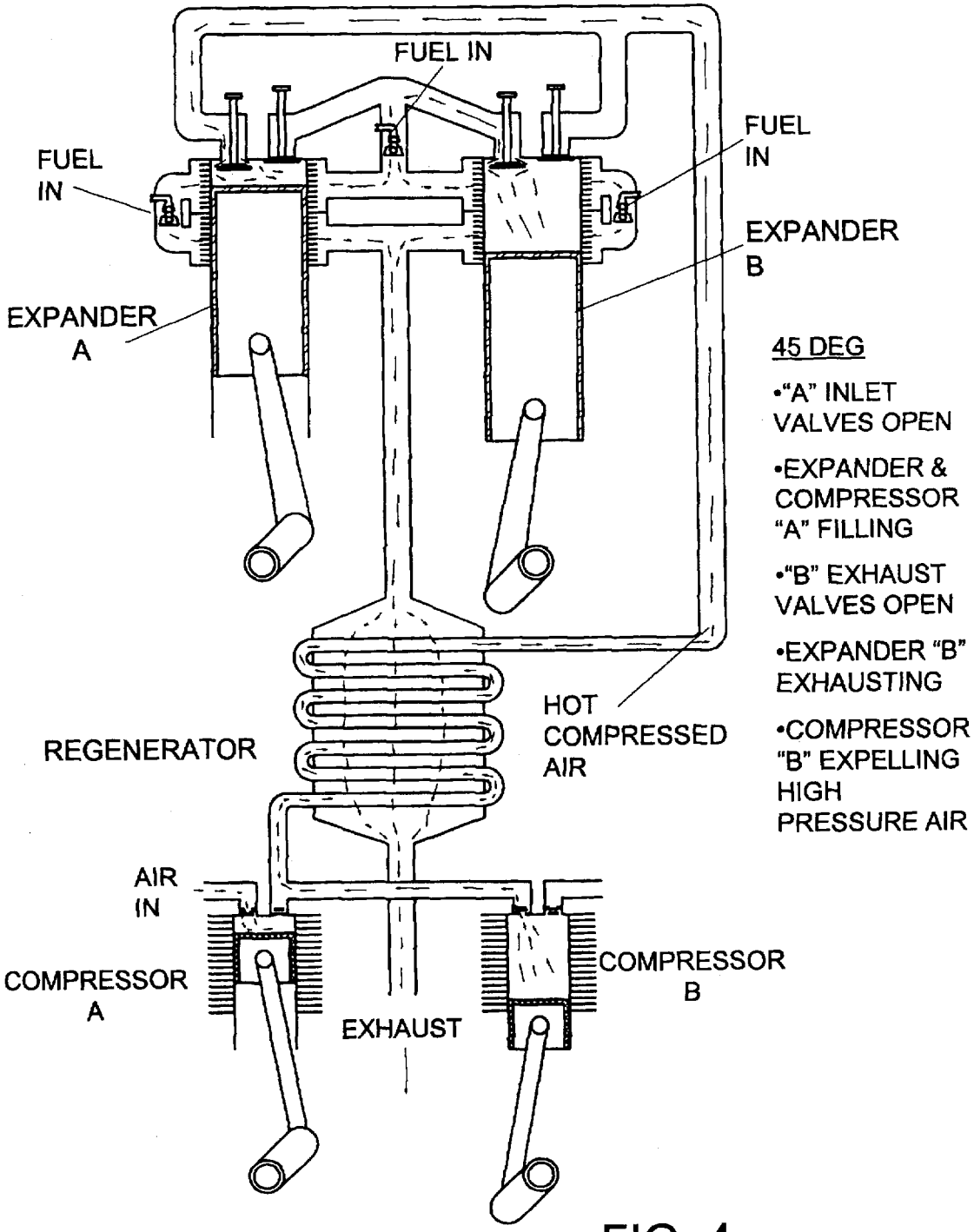

FIG. 4 shows the 45 degree position. Both "A" inlet valves have opened and both "A" pistons have loved away from TDC and are filling with air. Both "B" exhaust valves have opened and both "B" pistons have moved away from BDC to expel low-pressure air from the expander and high-pressure air from the compressor.

Figure 5:
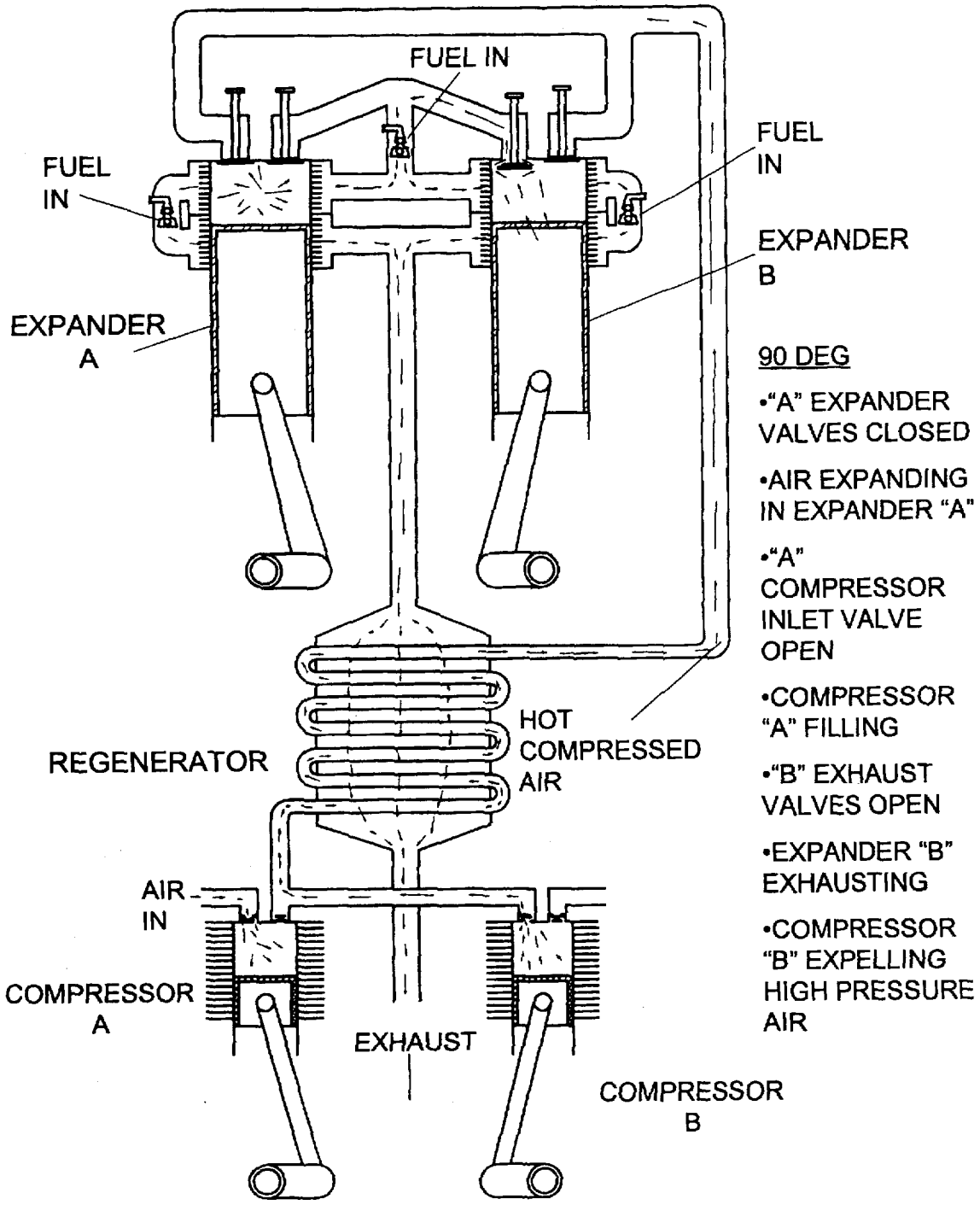

FIG. 5 shows the 90 degree position. Both "A" expander valves are closed and the piston is moving toward BDC to expand air in the expander cylinder. The "A" compressor inlet valve has opened and the "A" compressor cylinder is filling with air as the piston is moving toward BDC. Both "B" pistons have moved more toward TDC, and both "B" exhaust valves are open, so that both pistons are continuing to expel air.

Figure 6:
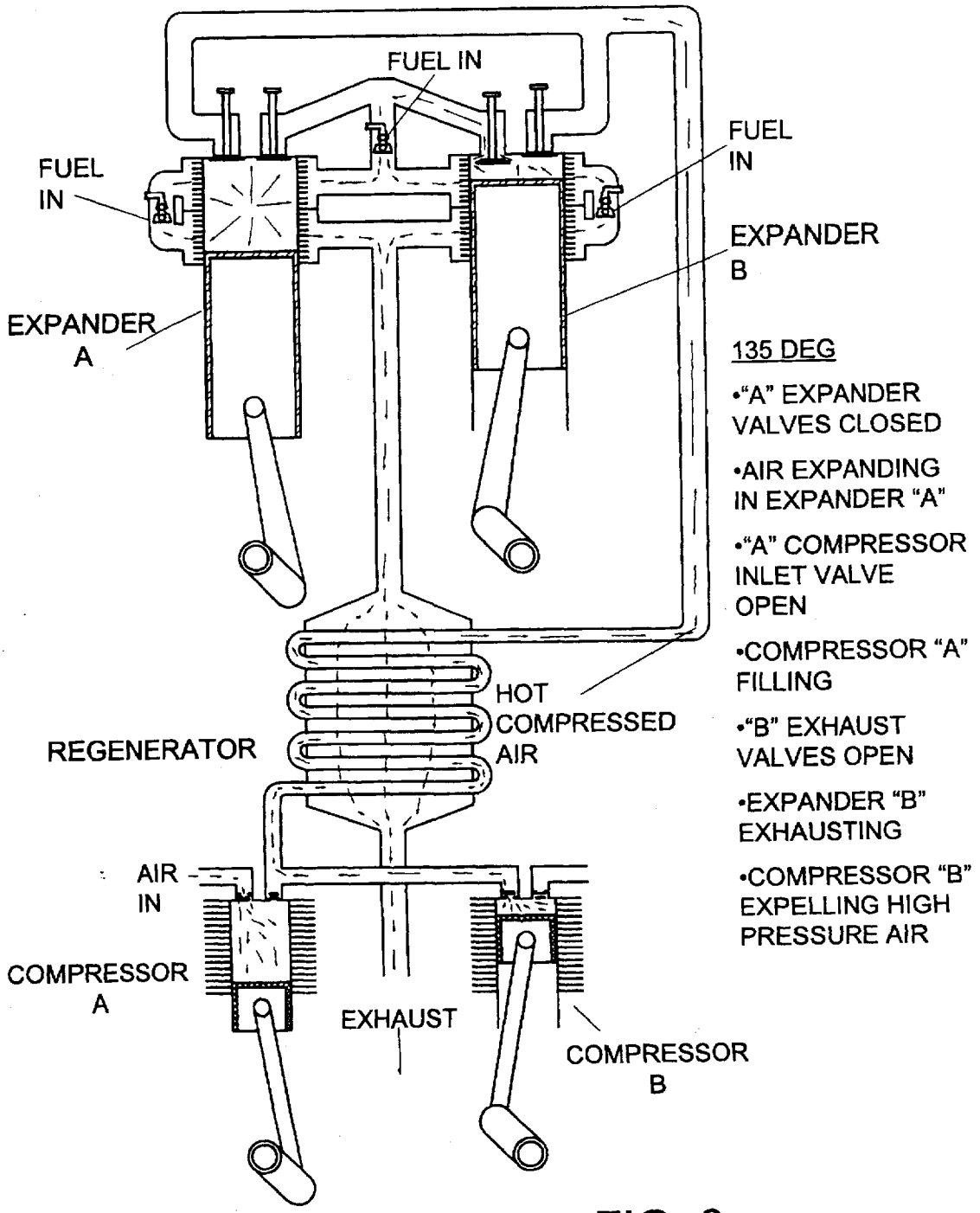

FIG.6 shows the 115 degree position. The "A" valve positions are as in FIG. 5 while both "A" pistons have moved close to BDC, and the flows of FIG,5 are continuing. Likewise, conditions in the "B" cylinders are as in FIG. 5, except that both pistons have moved closer to TDC.

Figure 7:
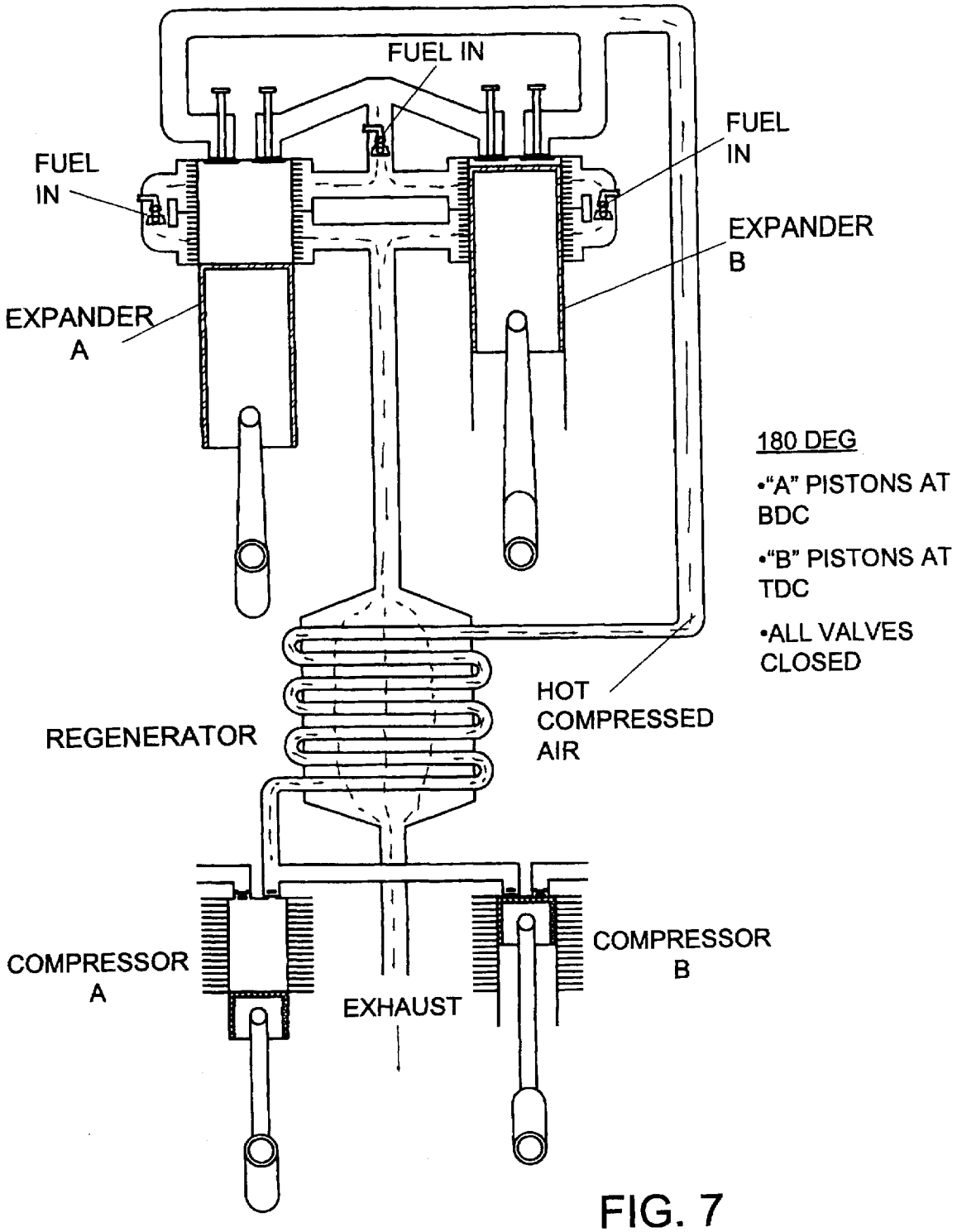

FIG. 7 shows the 180 degree position, at half cycle. Conditions are the same as in the start position of FIG. 3 at zero degrees, with all valves closed, except that the "A" and "B" cylinders have changed places. Now both "A" pistons are at BDC, and both "B" pistons are at TDC.

Figure 8:
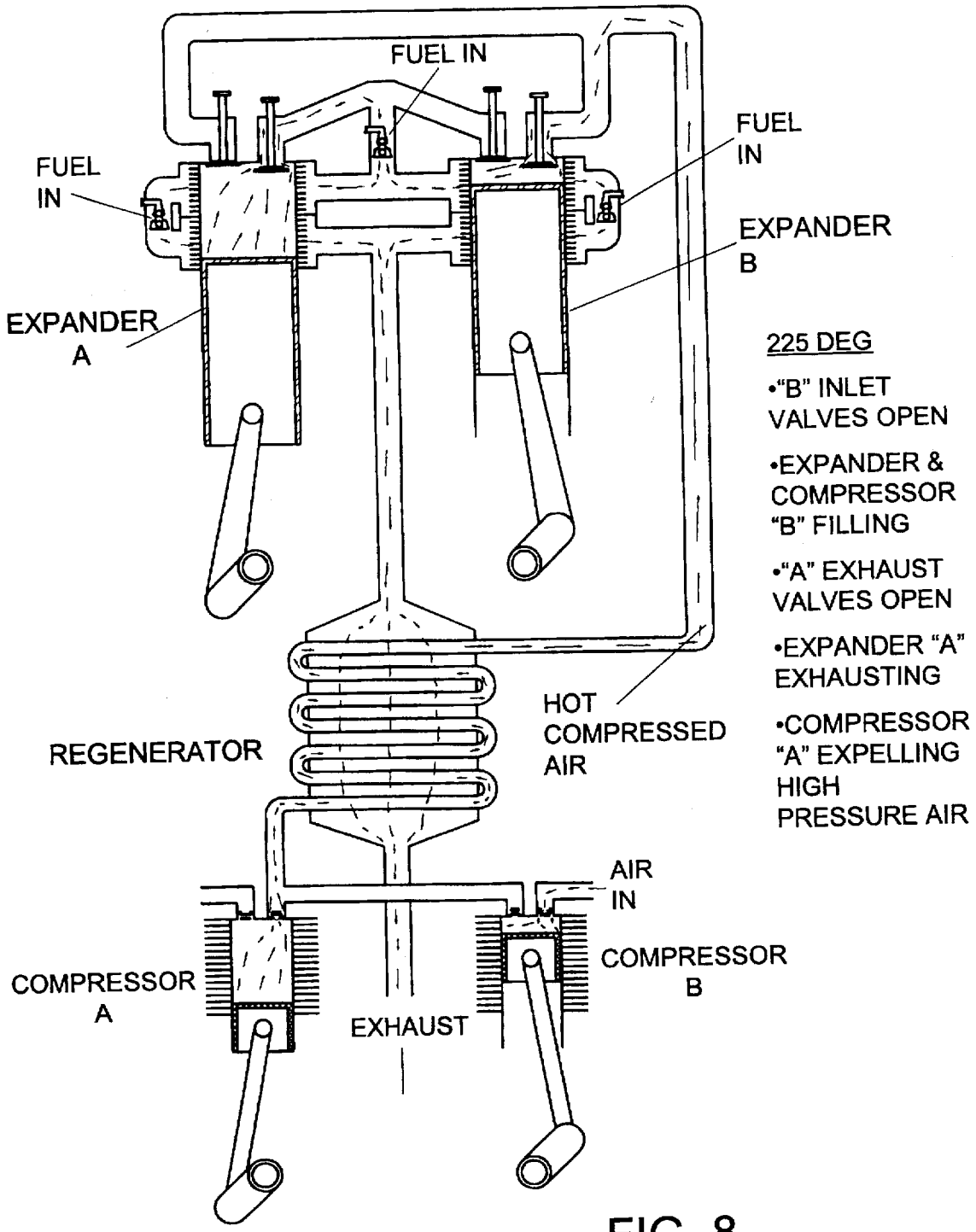

FIG. 8 shows the 225 degree position. This is the reverse of FIG. 4 at 45 degrees. The "A" cylinders have started to move away from BDC, the exhaust valves are open, and air is moving out of both cylinders. The "B" cylinders have started to move away from TDC, the inlet valves are open and both cylinders are filling.

Figure 9:
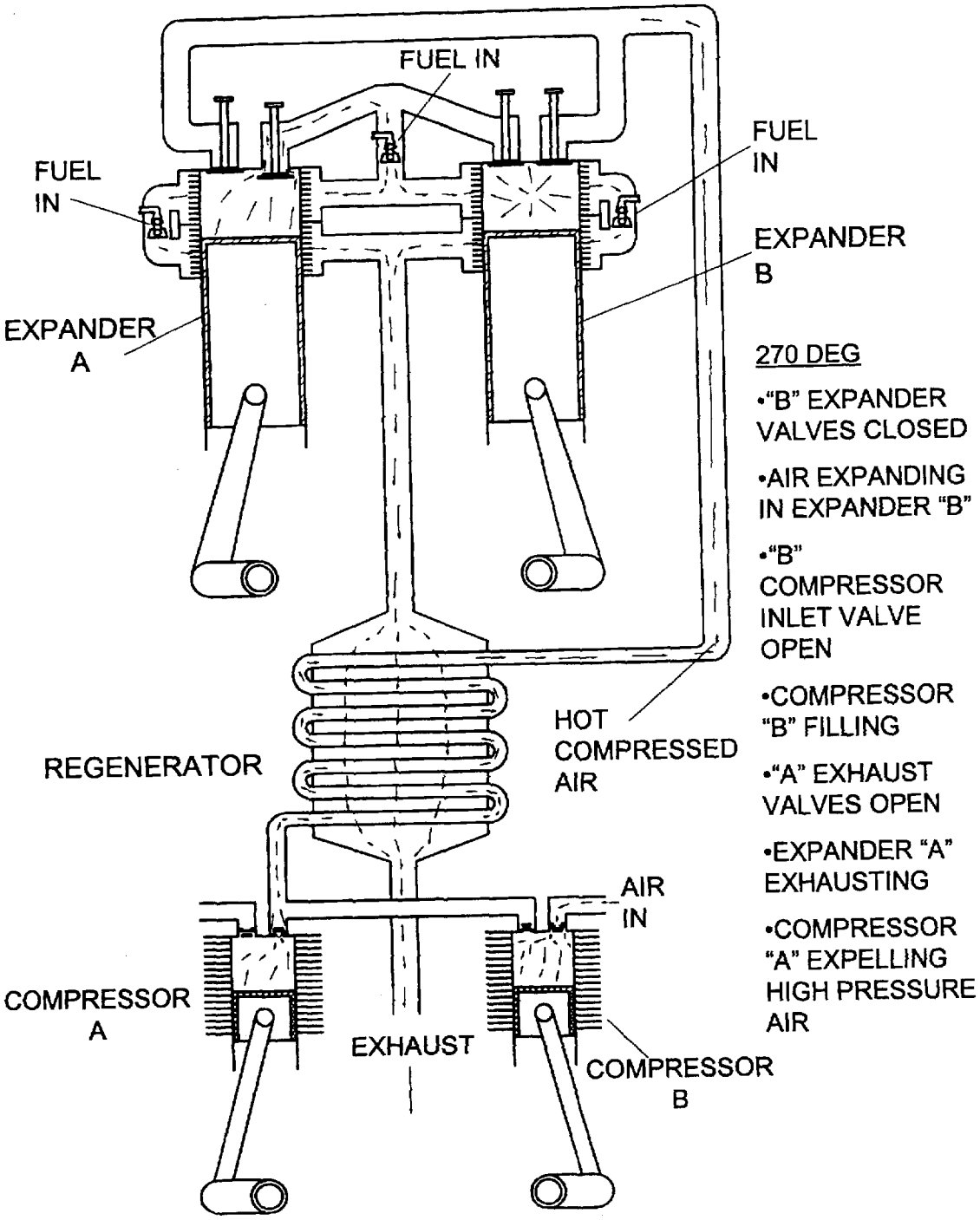

FIG. 9 shows the 270 degree position. This is the reverse of FIG. 5 at 90 degrees. The "A" pistons have moved further away from BDC, the "A" exhaust valves are open, and air is continuing to move out of both "A" cylinders. The "B" pistons have moved farther away from TDC. The "B" expander valves are closed and air is expanding in the "B" expander. The "B" compressor intake valve has opened and the "B" compressor is filling with air.

Figure 10:
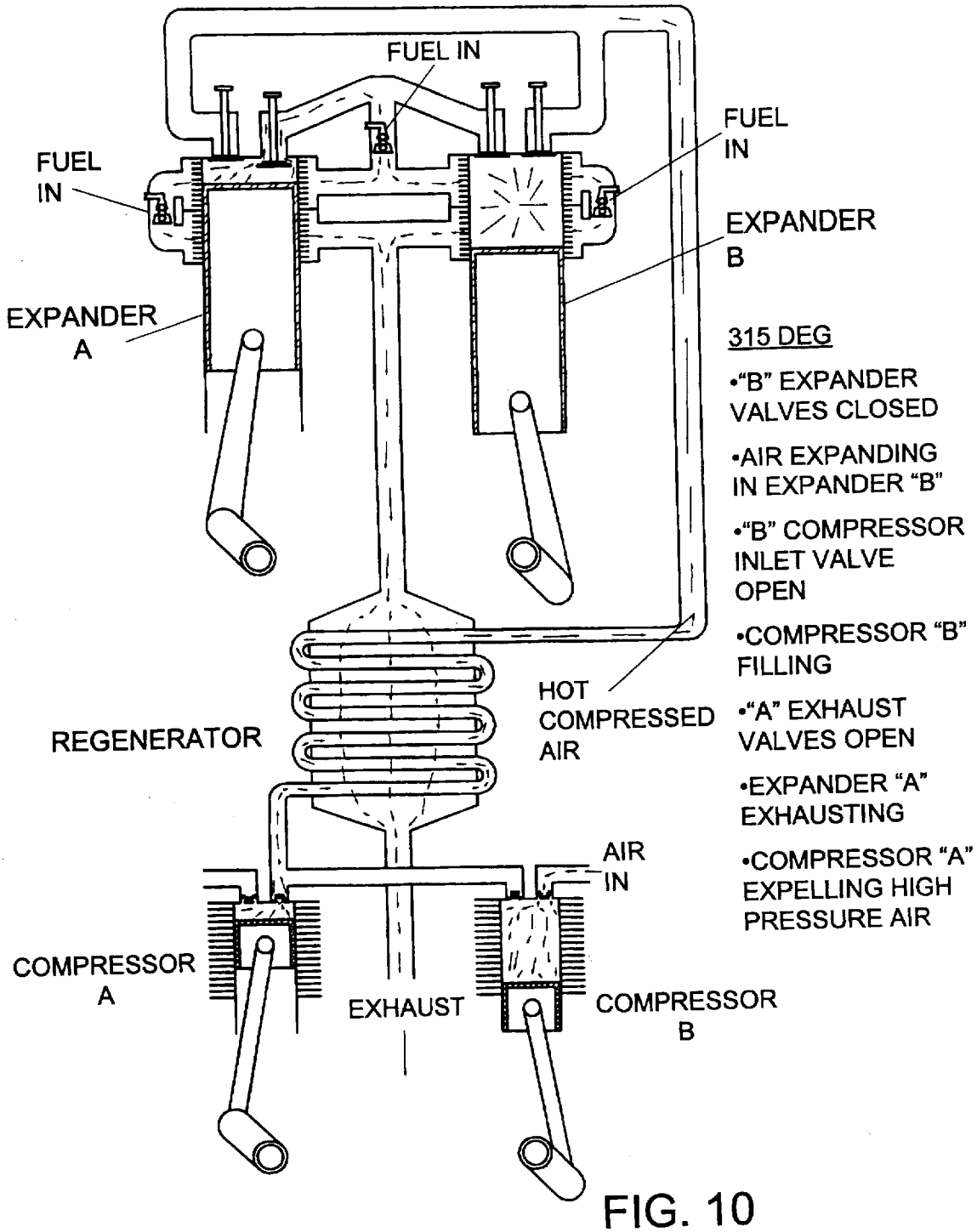

FIG. 10 shows the 315 degree position. This is the reverse of FIG. 6 at 135 degrees. The "A" pistons have moved close to TDC, both "A" exhaust valves are open, and air is continuing to move out of both "A" cylinders. The "B" cylinders have approached BDC. The "B" expander valves are still closed and air is continuing to expand in expander "B". The "B" compressor inlet valve is still open and the "B" compressor is continuing to fill.

FIG. 3 shows the 360 degree position which is identical with the zero degree position. All valves are closed. The "A" pistons have reached TDC, and the "B" pistons have reached BDC. The cycle is ready to start again.

During this cycle the regenerator and afterburner have been connected in parallel. With both sets of cylinders and have been operating continuously at steady state because of the "mirror" action of the "A" and "B" reciprocating machinery, as demonstrated in FIGS. 3–10 above. The thermal equilibrium so attained in the heat transfer components reduces thermal losses to a minimum and raises engine efficiency.

Engine Speed and Power Control

Figure 12:
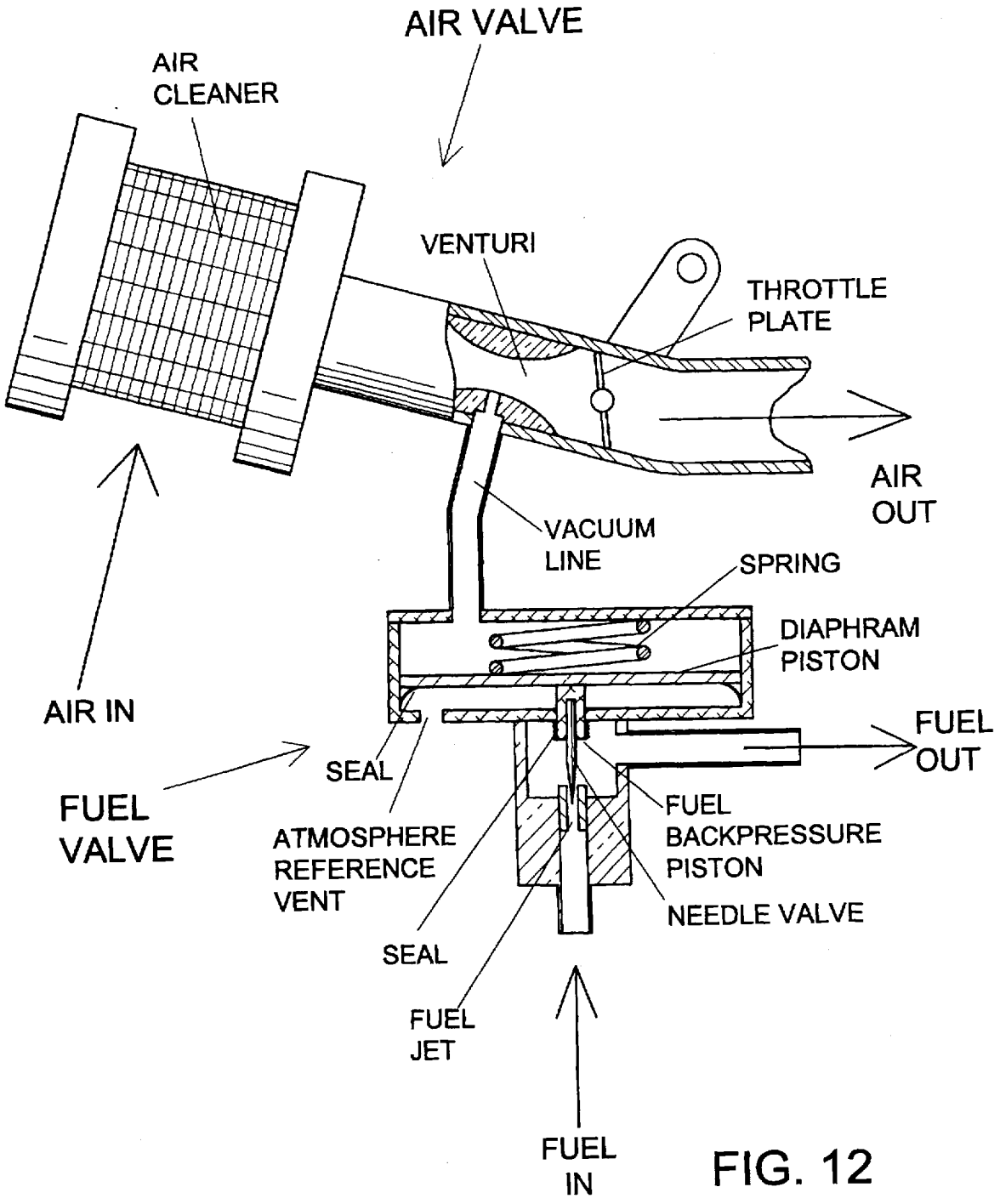
FIG. 12 is a schematic view of the air and fuel flow control system.

Referring now to FIG. 12, a vacuum flow control system for control of engine speed and power is shown, comprising an air valve and a fuel valve which are interconnected. Such a system is independent of the number of cylinders in the engine.

Air enters the engine through an air cleaner and is ducted through the air valve which consists of a venturi and a conventional butterfly throttle plate for air flow control. A vacuum line from the throat of the venturi connects to the fuel valve which controls fuel flow.

In the fuel valve a movable tapered needle valve meters the fuel entering through a fuel jet orifice. The needle valve is integral with a fuel backpressure piston which abuts a spring-loaded diaphragm piston. The needle valve metering position is determined by (1) the vacuum it the vacuum line from the venturi throat, (2) the burner backpressure, (3) an atmospheric reference vent and (4) the spring loading.

When air flow is zero, the spring action pushes the needle valve into the fuel jet orifice to close off fuel flow. As air flow begins and increases, the venturi vacuum increases correspondingly. The diaphragm then compresses the fuel valve spring and causes the tapered needle valve to move further out of the fuel jet to increase the fuel flowrate. Burner backpressure is accounted for by the fuel backpressure piston which counteracts the tendency for reduced fuel flow due to increasing backpressure by moving the needle valve out of the fuel jet to increase the effective orifice size.

Ideally, the air/fuel ratio is maintained nearly constant to maintain a constant expander temperature so that throttle response is not affected by thermal lags due to variations in the temperature level of the engine components.

Figure 13:
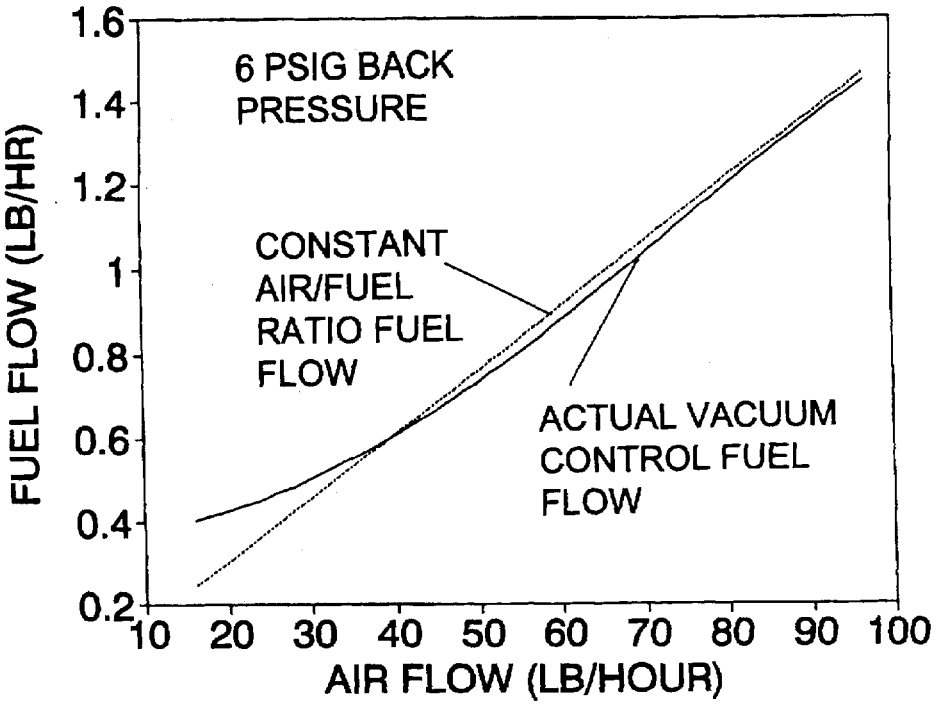
FIG. 13 is a graph of fuel valve performance at 6 psig back pressure.
Figure 14:
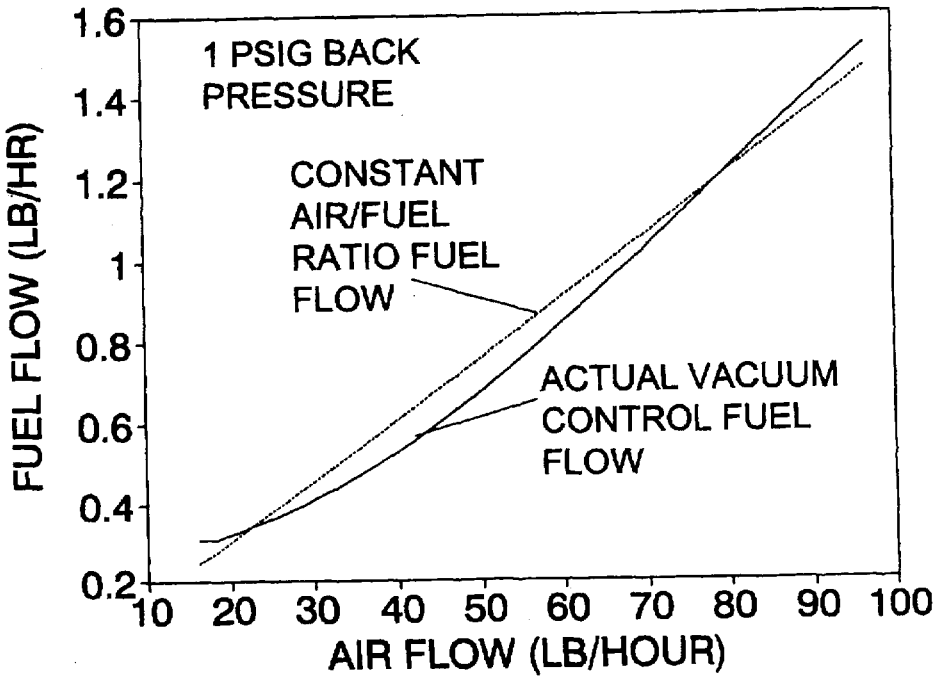
FIG. 14 is a graph of fuel valve performance at 1 psig back pressure.
Figure 15:
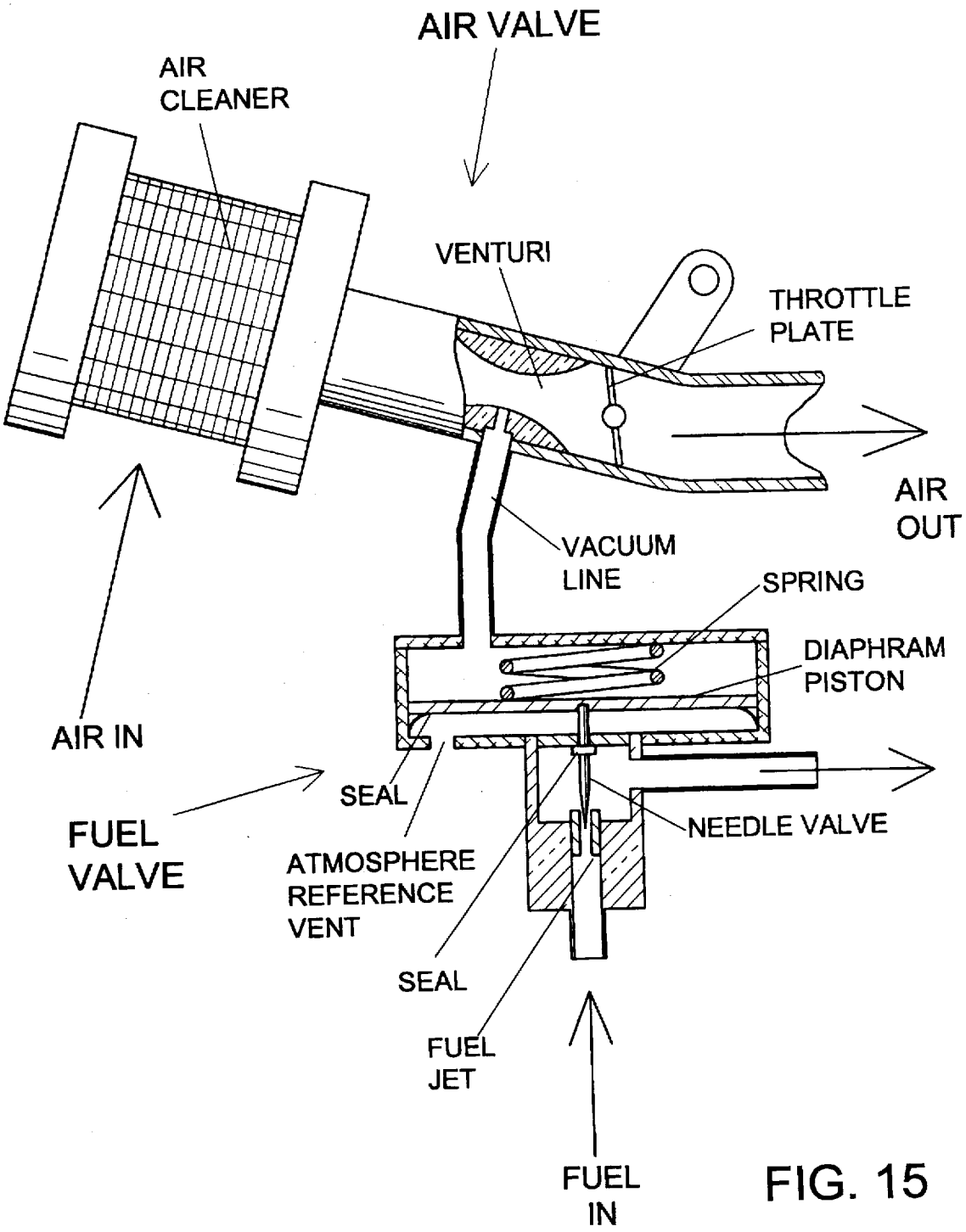
FIG. 15 is a schematic of the air and fuel flow control system simplified for a gaseous fuel.
Figure 16:
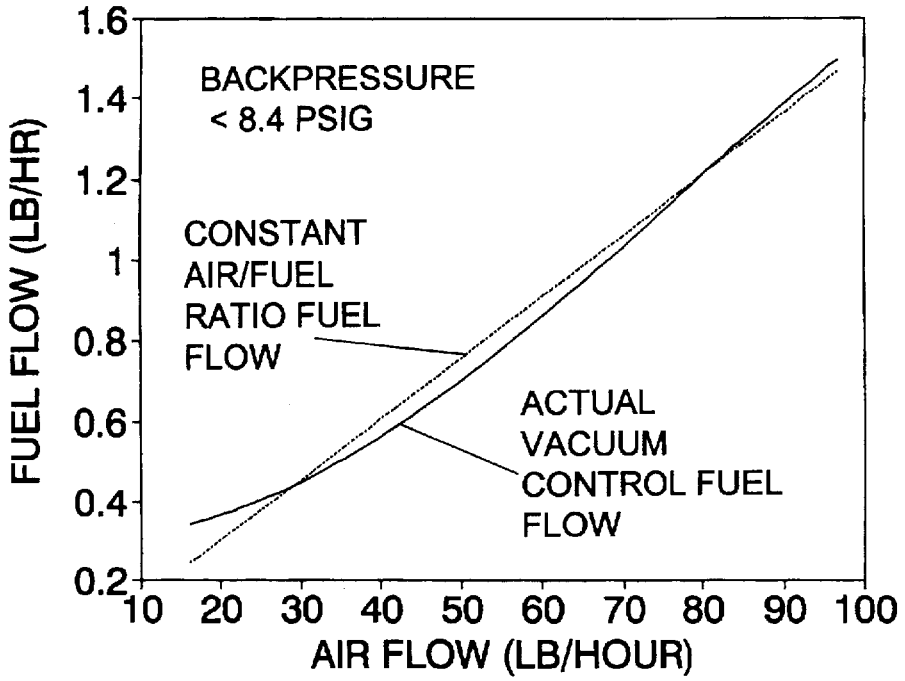
FIG. 16 is a graph of fuel valve performance for a gaseous fuel.

Referring now to FIGS. 13 and 14, graphs of typical fuel valve performance are shown in terms of fuel flow as a function of air flow, as generated by a computer model of the fuel valve. The back pressure is 6 psig in FIG. 15, and 1 psig in FIG. 14.

The design air flow for this engine is 60 pounds per hour. Over a range of air flows from 15 to 95 pounds per hour (25% to 125% of design) the vacuum fuel control is able to maintain a nearly constant fuel/air ratio in both FIG. 13 and FIG. 14.

The fuel, valve shown in FIG. 12 can be used with both liquid and gaseous fuels. If a gas phase fuel is used, the fuel valve can be simplified by raising the fuel inlet pressure sufficiently so that the fuel orifice is "choked" (i.e., at sonic velocity) over the range of expected burner backpressures. In that case the fuel flow is determined solely by conditions upstream of the fuel orifice. This means that the backpressure piston can be eliminated to simplify the fuel valve, Referring now to FIG. 15, a simplified version of the flow control system without a backpressure piston is shown. The needle valve is now directly attached to the diaphragm piston. All other components are as in FIG. 12.

Referring now to FIG,16, a graph of typical choked gas fuel valve performance is shown in terms of fuel flow as a function of air flow, as generated by a computer model of the choked system. The fuel is propane gas at 30 psia inlet pressure, which will keep the orifice choked at backpressures up to 8.4 psia.

The design air flow for this system is 80 pounds per hour. Over a range of air flows from 15 to 95 pounds per hour (25% to 125% of design) the vacuum fuel control is able to maintain a nearly constant fuel/air ratio. This duplicates the performance of the liquid fuel control system as shown in FIGS. 13 and 14.

Engine Materials

Engine materials are generally aluminum for the colder components such as compressor, blower and connecting rods, and stainless steel for the hot components such as afterburner, regenerator and expander, with a steel crankshaft.

Referring again to FIG,2, compressor piston la is a standard aluminum piston with conventional piston rings. Expander piston **2*e* has a thin high-temperature steel extension 2*k* which allows piston rings 2*m* to remain in the unheated lower portion of the expander cylinder in the manner of a Heylandt expander. The lower piston ring temperature assures long life sealing and allows the use of conventional oil for lubrication. Expander intake valve 2*b* and exhaust valve 2*c*** need to withstand high temperatures. For this reason ceramic poppet valves are preferred. Such valves are currently being produced by TRW Automotive and General Motors for automotive applications. P Obviously, within the purview of the afterburning Ericsson cycle here disclosed, many hardware modifications and variations are possible. These include multi-cylinder crank arrangements and multiple afterburner configurations. It is therefore understood that, within the scope of the appended claims, the invention may be practiced otherwise than as specifically described.

I claim:

1. A regenerative external combustion open cycle heat engine operating on the afterburning Ericsson cycle which achieves Carnot cycle efficiency, said engine comprising:

compressor means for compressing ambient air to a peak pressure;

a regenerator for receiving said air at peak pressure from said compressor means and for heating said air using regenerator heating means;

expander means for receiving said heated air at peak pressure from the regenerator and for expanding said air to a low pressure while further heating said air using expander heating means;

afterburner means for receiving said further heated air at low pressure from said expander means, mixing said air with a fuel to form a combustible air-fuel mixture, and igniting said air-fuel mixture to form hot combustion gases at a flame temperature;

an expander heat transfer passage located around said expander means for receiving said hot combustion gases in countercurrent flow from said afterburner means whereby heat is transferred from said hot combustion gases to expanding air in said expander means, the combination of said hot gases and said expander heat transfer passage constituting said expander heating means, with said hot gases exiting said expander heat transfer passage at reduced temperature in countercurrent flow into the regenerator, constituting said regenerator heating means, said hot gases being cooled in the regenerator and discharged from the regenerator to atmosphere.

2. The engine of claim 1 wherein the fuel is a liquid.

3. The engine of claim 1 wherein the fuel is a gas.

4. The engine of claim 1 further comprising a system for control of engine fuel flow, said system comprising:

an air valve in an engine inlet system, said air valve comprising a venturi, and a butterfly throttle plate actuated by an operator; and a fuel valve connected to said air valve by a vacuum line from a throat of said venturi, said fuel valve comprising a needle valve controlling fuel inflow through an orifice, said needle valve being integral with a burner backpressure piston which attached to a spring-loaded diaphragm piston, whereby the combined action of said vacuum, said burner backpressure and said spring loading determine needle valve position and fuel flow, the system so designed to produce a practically constant fuel-air ratio in said afterburner means regardless of variable burner backpressure resulting from variable engine speed and variable load.

5. The engine of claim 1 further comprising a system for control of engine fuel flow for gas phase fuels, said system comprising:

an air valve in an engine air inlet system, said air valve comprising a venturi, and a butterfly throttle plate actuated by an operator; and a fuel valve connected to said air valve by a vacuum line from a throat of said venturi, said fuel valve comprising a needle valve controlling inflow of gas phase fuel through an orifice kept at sonic flow conditions by a sufficiently high gas phase fuel inlet pressure, said needle valve being attached to a spring-loaded diaphragm piston, whereby the combined action of said vacuum and said spring loading determine needle valve position and gas phase fuel flow, the system so designed to produce a practically constant fuel-air ratio in said afterburner means regardless of engine speed and load.

6. The engine of claim 1 wherein said compressor means is at least one compressor cylinder comprising at least one compressor intake valve and at least one compressor exhaust valve and a reciprocating compressor piston connected by a compressor connecting rod to an engine crankshaft, and wherein said expander means is at least one expander cylinder comprising at least one expander intake valve and at least one expander exhaust valve and a reciprocating expander piston connected by an expander connecting rod to said crankshaft, the number of compressor cylinders equaling the number of expander cylinders, with the crank phase angles of said compressor cylinders and said expander cylinders arranged for proper operation of an afterburning Ericsson cycle during one revolution of said crankshaft which said crankshaft transmits engine shaft power output to a load.

7. The engine of claim 6 with two compressor cylinders and two expander cylinders, so arranged on said crankshaft that one pair of compressor and expander cylinders is in synchronized piston reciprocation 180 degrees out of phase with synchronized piston reciprocation of the other pair of compressor and expander cylinders, thus producing constant continuous air flow to said afterburner means with resulting steady state combustion.

8. The engine of claim 6 wherein: said compressor piston is a standard aluminum piston with conventional piston rings; said expander piston is made of stainless steel with stainless steel expander piston rings and a thin high-temperature steel extension which allows said expander piston rings to operate at low temperature with conventional oil for lubrication; and said expander intake valve and said expander exhaust valve are ceramic poppet valves to withstand high expander operating temperatures.

9. The engine of claim 6 wherein said compressor cylinder further comprises external cooling fins from which the heat of compression is removed by an engine-powered air blower.

10. The engine of claim 6 wherein said compressor cylinder further comprises external cooling jackets through which is circulated a coolant which removes the heat of compression via a radiator.

11. The engine of claim 1 wherein said afterburner means are a primary afterburner located adjacent exit of said expander means and burning fuel with exiting low pressure expander air to produce a mixture of hot combustion gases and unreacted air, and a secondary afterburner located about halfway along said expander heat transfer passage and burning additional fuel with said unreacted air in said mixture, the combination of said primary afterburner and said secondary afterburner designed to maintain a close to uniform heating effect at a lower flame temperature along the length of said expander heat transfer passage.

12. The engine of claim 6 wherein said expander heat transfer passage comprises multiple annular flow dividers, each said flow divider partially encircling said expander cylinder to create a gap with a blocking plate which diverts flow through said gap to the next adjacent said flow divider, said flow so passing through all said flow dividers in a circular stair step manner around the entire said expander cylinder to produce a high rate of heat transfer from said flow to said expander cylinder.

13. A starting method for a regenerative heat engine operating on the afterburning Ericsson cycle, said engine comprising at least one valved compressor cylinder with a reciprocating compressor piston connected by a compressor connecting rod to a crankshaft, at least one valved expander cylinder with a reciprocating expander piston connected by an expander connecting rod to said crankshaft, a regenerator with heating means receiving compressed air from said compressor cylinder and exhausting said compressed air to said expander cylinder, a primary afterburner with an igniter for burning fuel with air to produce hot gases, and an expander heat transfer passage receiving said hot gases from said primary afterburner for heating air in said expander cylinder, and a secondary afterburner about halfway along said expander heat transfer passage, said hot gases exiting from said expander heat transfer passage to form said regenerator heating means for heating said compressed air, said starting method comprising the steps of:

a. admitting a continuous air stream from an electrically driven starter blower via a start air valve to the primary afterburner;

b. turning on the primary afterburner igniter;

c. admitting a continuous fuel flow to the primary afterburner to form an ignitable fuel-air mixture flow with said continuous air stream which, said mixture flow being ignited by the afterburner igniter to form a self-sustaining continuous hot gas stream;

d. turning off the primary afterburner igniter;

e. circulating the hot gas stream from the primary afterburner through the expander heat transfer passage and further through the regenerator until the expander cylinder has warmed to a fuel ignition temperature;

f. admitting a continuous fuel flow to the secondary afterburner for expander cylinder hot surface ignition;

g. continuing combustion in both primary afterburner and secondary afterburner until expander cylinder and regenerator are heated to normal operating temperatures;

h. cranking the engine crankshaft by an electrically driven starter motor until engine begins to rotate; and i. turning off starter blower and start air valve to stop admission of air to primary afterburner, as engine begins normal operation.

14. A method of operation for a regenerative heat engine operating on the afterburning Ericsson cycle, said engine comprising at least one externally cooled compressor cylinder with a compressor intake valve, a compressor exhaust valve and a reciprocating compressor piston connected by a compressor connecting rod to a crankshaft, at least one externallly heated expander cylinder with an expander intake valve, an expander e exhaust valve and a reciprocating expander piston connected by an expander connecting rod to said crankshaft, a regenerator with heating means receiving compressed air from said compressor cylinder and exhausting said compressed air to said expander cylinder, a primary afterburner with an igniter for burning fuel with air to produce hot gases, and an expander heat transfer passage receiving said hot gases from said primary afterburner for heating air in said expander cylinder, and a secondary afterburner about halfway along said expander heat transfer passage, said hot gases exiting from said expander heat transfer passage to form said regenerator heating means for heating said compressed air, said method of operation comprising the steps of:

a. admitting air through the open compressor intake valve to the compressor cylinder during the intake stroke of the compressor piston as said piston moves from top dead center to bottom dead center, with the compressor exhaust valve closed;

b. closing the compressor intake valve and compressing air in the externally cooled compressor cylinder during the compression stroke of the compressor piston as said piston moves from bottom dead center toward top dead center;

c. opening the compressor exhaust valve toward the end of said compression stroke as the compressor piston approaches top dead center, and transferring the compressed air from the compressor cylinder to the regenerator in which the compressed air is heated by the regenerator heating means of hot gases;

d. transferring the heated compressed air from the regenerator through the open expander intake valve, to the expander cylinder which is externally heated by the expander heating means of hot gases, during the expansion stroke of the expander piston as the expander piston moves from top dead center toward bottom dead center, with the expander exhaust valve closed;

e. closing the expander intake valve partway through the expansion stroke for improved expansion of the air in the expander cylinder, said expanding air being maintained at neatly constant temperature due to the external heating of the expander cylinder with a resultant output of shaft work at the crankshaft;

f. opening the expander exhaust valve at the end of the expander piston expansion stroke when the expander piston reaches bottom dead center to transfer the completely expanded low pressure air to the primary afterburner;

g. adding fuel to the air in the primary afterburner to form an air-fuel mixture and igniting said mixture to produce a low pressure hot gas stream containing some unburned air;

h. transferring said hot gas stream to the expander heat transfer passage around the expander cylinder and so transferring heat from said hot gas stream in the expander heat transfer passage to the expanding air in the expander cylinder;

i. reheating said hot gas stream about halfway along the expander heat transfer passage by the secondary afterburner in which additional fuel is injected to combine, ignite and burn with the unburned air in said hot gas stream to maintain the heat transfer from the expander heat transfer passage to the expanding air in the expander cylinder;

j. transferring said low pressure hot gas stream from the expander heat transfer passage to the regenerator as the heating means which heats the compressed air transferred by the compressor cylinder to the regenerator; and k. exhausting said low pressure hot gas stream from the regenerator to the atmosphere.

* * * * *